US010760807B2

(12) United States Patent
Jang et al.

(10) Patent No.: US 10,760,807 B2
(45) Date of Patent: Sep. 1, 2020

(54) AIR CONDITIONER AND CONTROL METHOD THEREFOR

(71) Applicant: Samsung Electronics Co., Ltd., Suwon-si, Gyeonggi-do (KR)

(72) Inventors: Yong Hee Jang, Yongin-si (KR); Hyung Mo Koo, Suwon-si (KR); Byoung Guk Lim, Suwon-si (KR); Il Yong Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 50 days.

(21) Appl. No.: 15/765,856

(22) PCT Filed: Oct. 17, 2016

(86) PCT No.: PCT/KR2016/011631
§ 371 (c)(1),
(2) Date: Apr. 4, 2018

(87) PCT Pub. No.: WO2017/069472
PCT Pub. Date: Apr. 27, 2017

(65) Prior Publication Data

US 2018/0299157 A1 Oct. 18, 2018

(30) Foreign Application Priority Data

Oct. 20, 2015 (KR) ..... 10-2015-0146020

(51) Int. Cl.
*F24F 11/42* (2018.01)
*F24F 1/08* (2011.01)
(Continued)

(52) U.S. Cl.
CPC ..... *F24F 11/42* (2018.01); *F24F 1/00* (2013.01); *F24F 1/08* (2013.01); *F24F 1/14* (2013.01);
(Continued)

(58) Field of Classification Search
CPC ..... F24F 1/00; F24F 1/08; F24F 1/14; F24F 1/26; F24F 1/32; F24F 1/60; F24F 11/00;
(Continued)

(56) References Cited

U.S. PATENT DOCUMENTS 8,215,121 B2 * 7/2012 Yoshimi ..... F25B 13/00 62/149
8,261,574 B2 * 9/2012 Sato ..... F25B 41/00 62/470
(Continued)

FOREIGN PATENT DOCUMENTS

CN 104048366 9/2014
JP 2002-106986 4/2002
(Continued)

OTHER PUBLICATIONS

International Search Report dated Dec. 14, 2016 in International Patent Application No. PCT/KR2016/011631.
(Continued)

*Primary Examiner* — Elizabeth J Martin
*Assistant Examiner* — Chang H Park
(74) *Attorney, Agent, or Firm* — Staas & Halsey LLP

(57) ABSTRACT

An air conditioner according to the present invention has a structure driving a compressor and a pump, simultaneously, in a low-temperature cooling environment in which the outdoor temperature is lower than the indoor temperature.

15 Claims, 17 Drawing Sheets

(51) Int. Cl.

| | |
|---|---|
| ***F24F 1/14*** | (2011.01) |
| ***F24F 1/60*** | (2011.01) |
| ***F24F 11/89*** | (2018.01) |
| ***F24F 11/00*** | (2018.01) |
| ***F24F 1/00*** | (2019.01) |
| ***F24F 1/26*** | (2011.01) |
| ***F25B 49/02*** | (2006.01) |
| ***F24F 1/32*** | (2011.01) |
| ***F24F 140/10*** | (2018.01) |
| ***F24F 110/10*** | (2018.01) |
| ***F24F 110/12*** | (2018.01) |
| ***F24F 140/20*** | (2018.01) |

(52) U.S. Cl.
CPC ..... *F24F 1/26* (2013.01); *F24F 1/32* (2013.01); *F24F 1/60* (2013.01); *F24F 11/00* (2013.01); *F24F 11/89* (2018.01); *F25B 49/02* (2013.01); *F24F 2110/10* (2018.01); *F24F 2110/12* (2018.01); *F24F 2140/10* (2018.01); *F24F 2140/20* (2018.01); *F25B 2341/0662* (2013.01); *F25B 2400/16* (2013.01); *F25B 2400/23* (2013.01); *F25B 2600/2513* (2013.01); *F25B 2600/2519* (2013.01); *F25B 2700/2106* (2013.01)

(58) Field of Classification Search
CPC ..... F24F 11/42; F24F 11/89; F24F 2110/10; F24F 2110/12; F24F 2140/10; F24F 2140/20; F25B 2341/0662; F25B 2400/16; F25B 2400/23; F25B 2400/0401; F25B 2400/0403; F25B 2600/2513; F25B 2600/2519; F25B 2700/2106; F25B 49/02
USPC ..... 62/196.1, 196.3, 196.4
See application file for complete search history.

(56) References Cited

U.S. PATENT DOCUMENTS

| | | | | |
|---|---|---|---|---|
| 8,925,337 | B2 * | 1/2015 | Poux ..... | F04D 15/0209 62/228.3 |
| 2009/0229285 | A1 | 9/2009 | Sato et al. | |
| 2015/0107294 | A1 | 4/2015 | Matsuura et al. | |
| 2015/0184905 | A1 | 7/2015 | Park et al. | |

FOREIGN PATENT DOCUMENTS

| | | |
|---|---|---|
| JP | 2006-322617 | 11/2006 |
| JP | 2007-212078 | 8/2007 |
| KR | 10-2009-0098691 | 9/2009 |
| KR | 10-2013-0090133 | 8/2013 |

OTHER PUBLICATIONS

Written Opinion of the International Searching Authority dated Dec. 14, 2016 in International Patent Application No. PCT/KR2016/011631.
Extended European Search Report dated Aug. 24, 2018 in European Patent Application No. 16857730.2.
Chinese Office Action dated Nov. 28, 2019 in corresponding Chinese Patent Application No. 201680061849.7.

* cited by examiner

【Fig. 1】
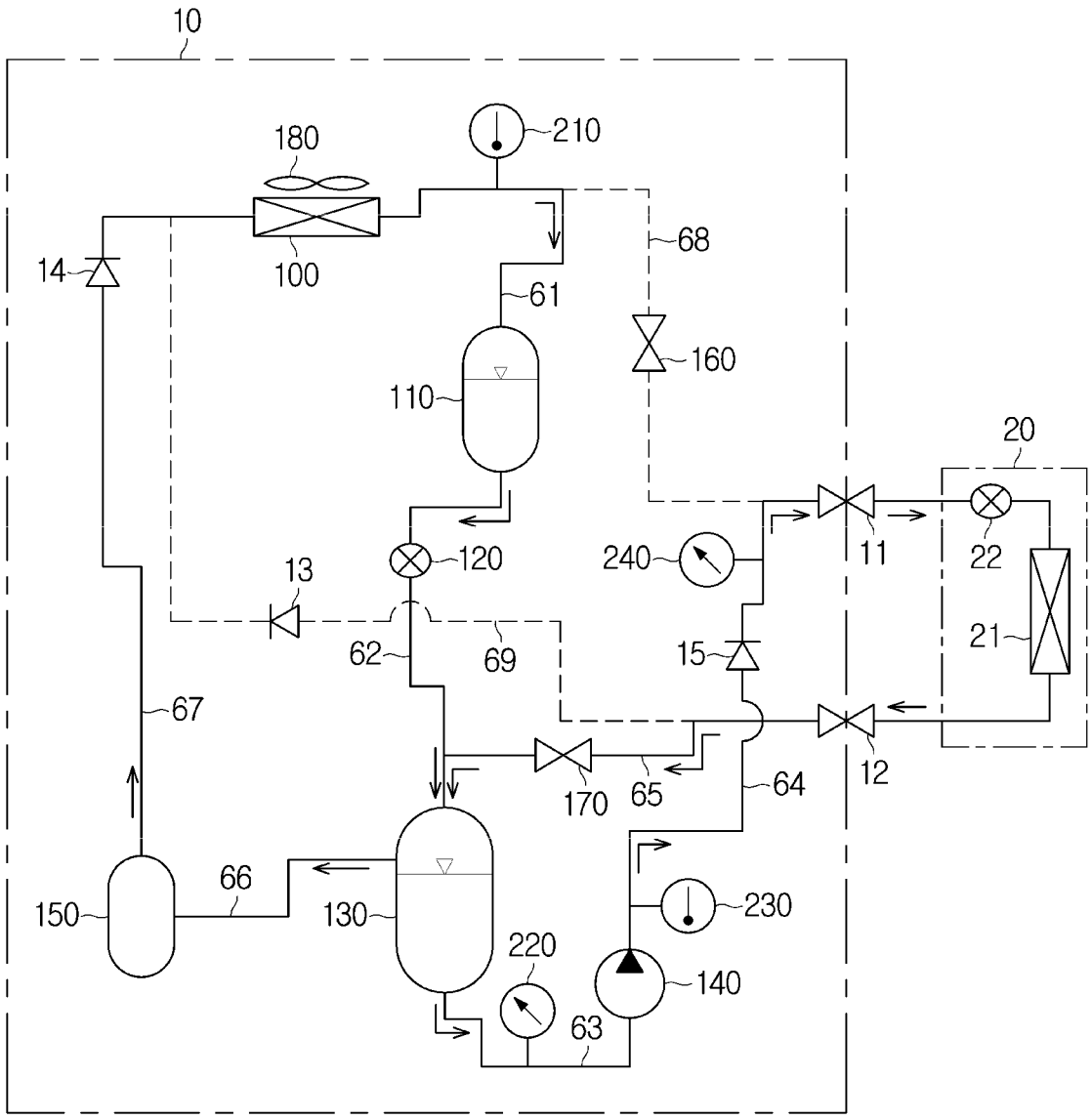

【Fig. 2】
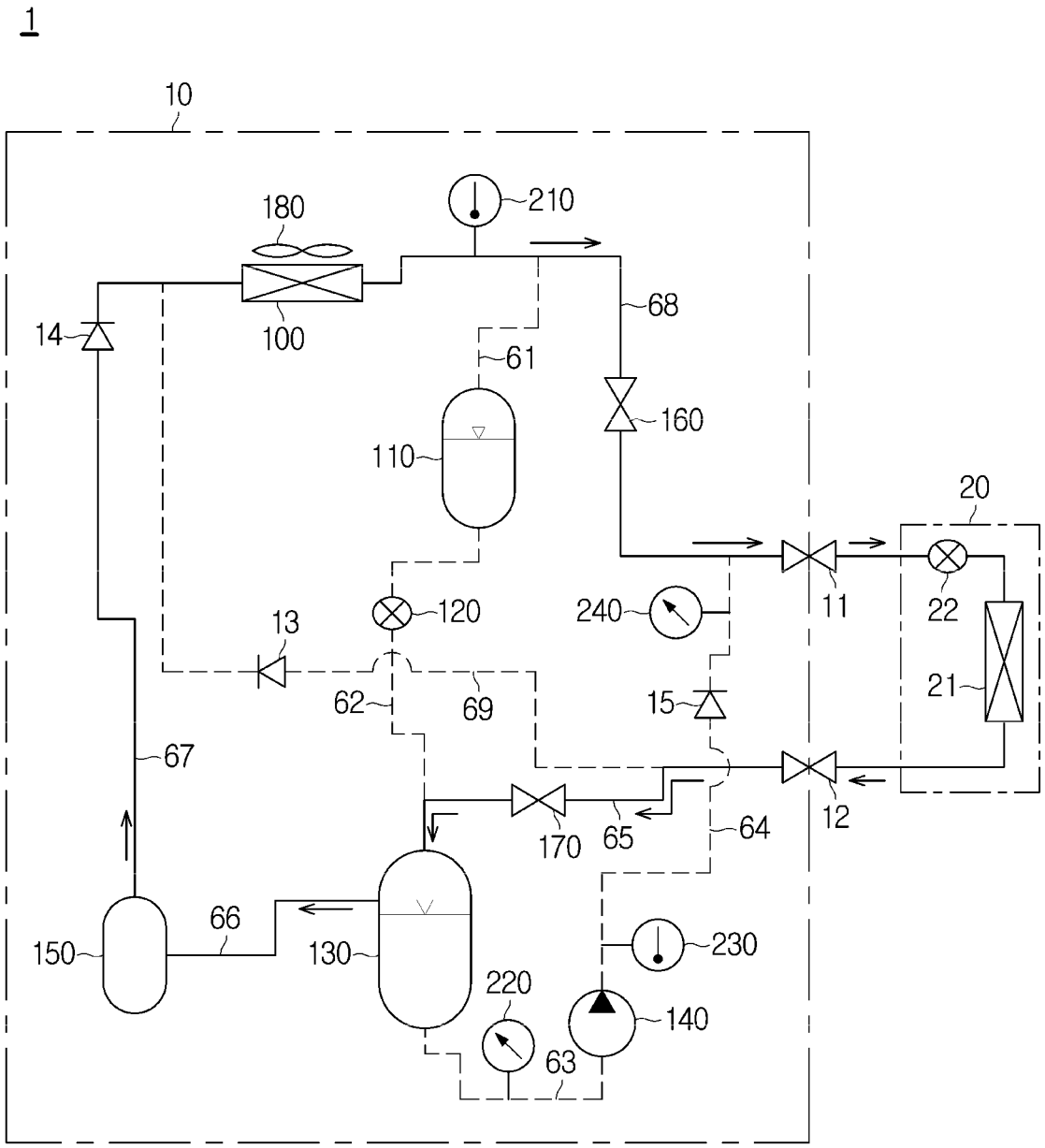

【Fig. 3】
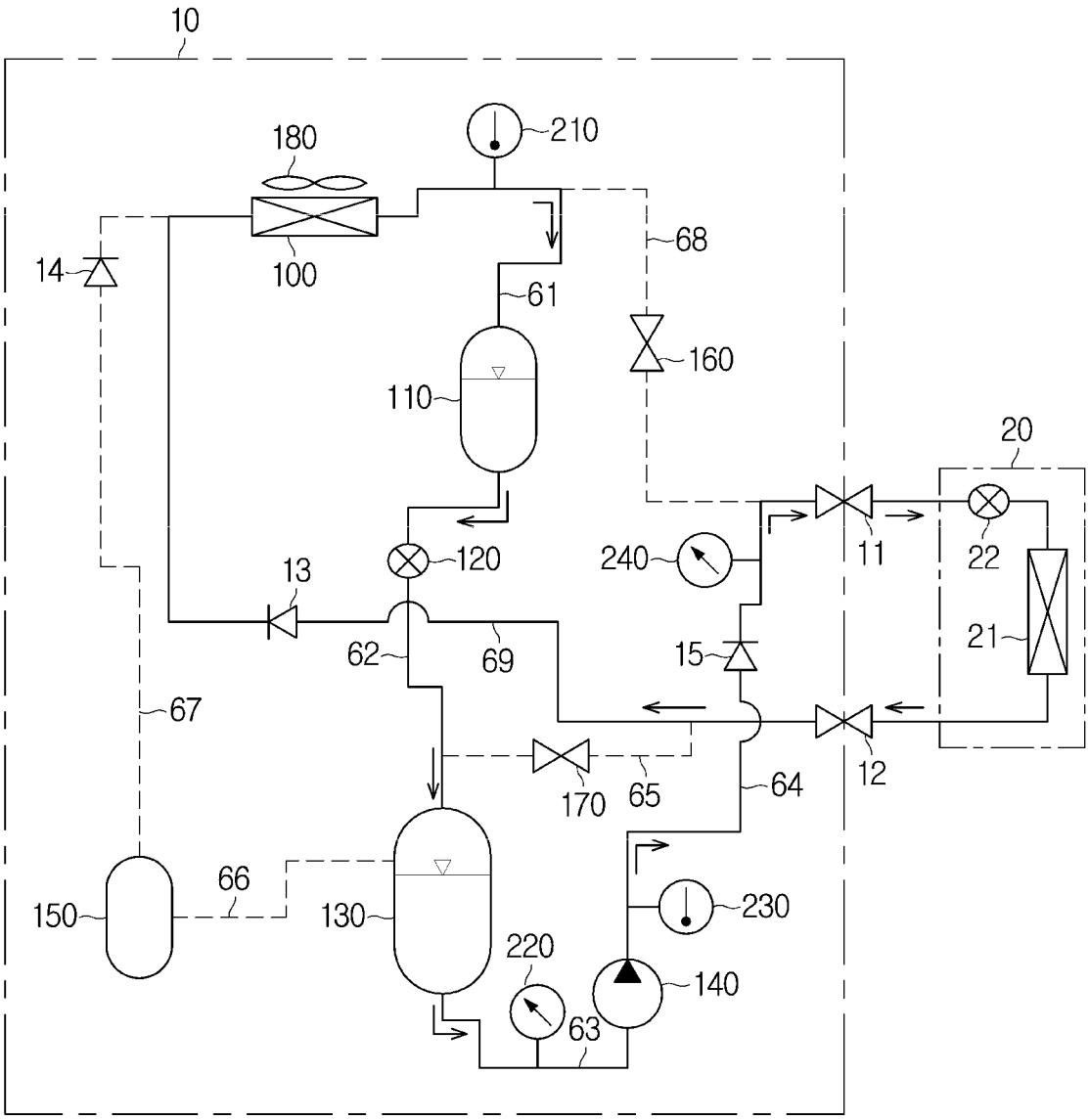

【Fig. 4】
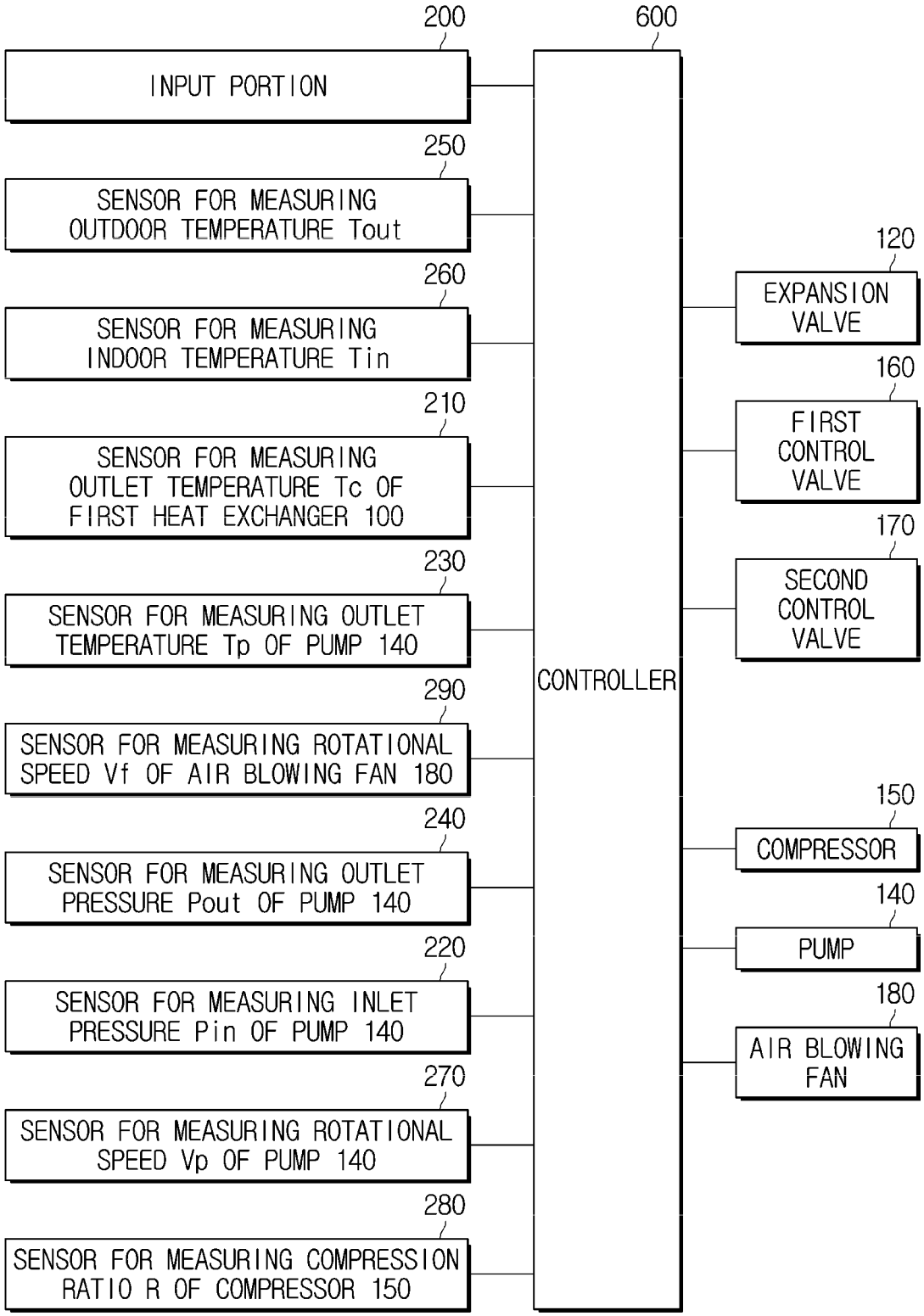

【Fig. 5a】
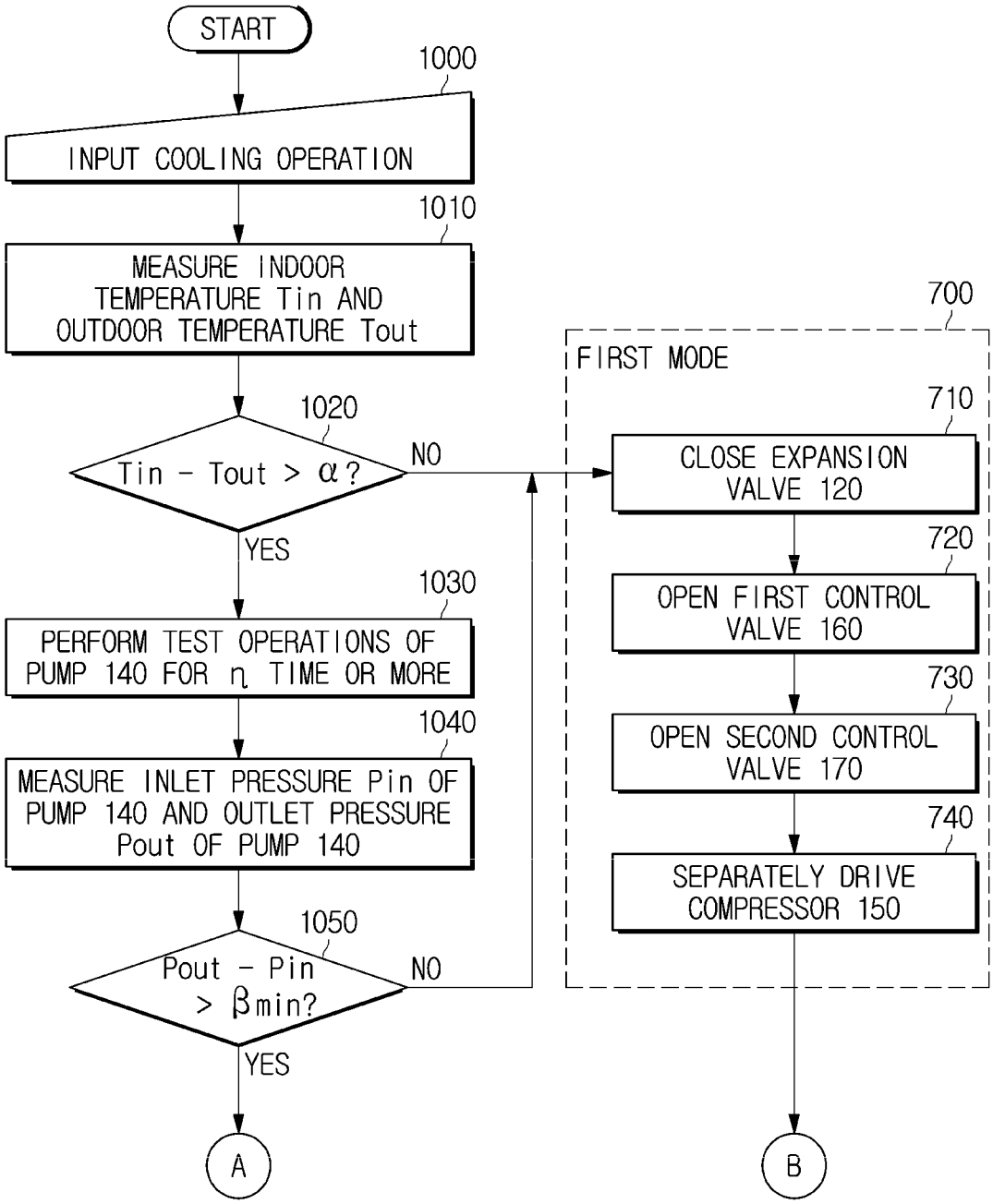

【Fig. 5b】
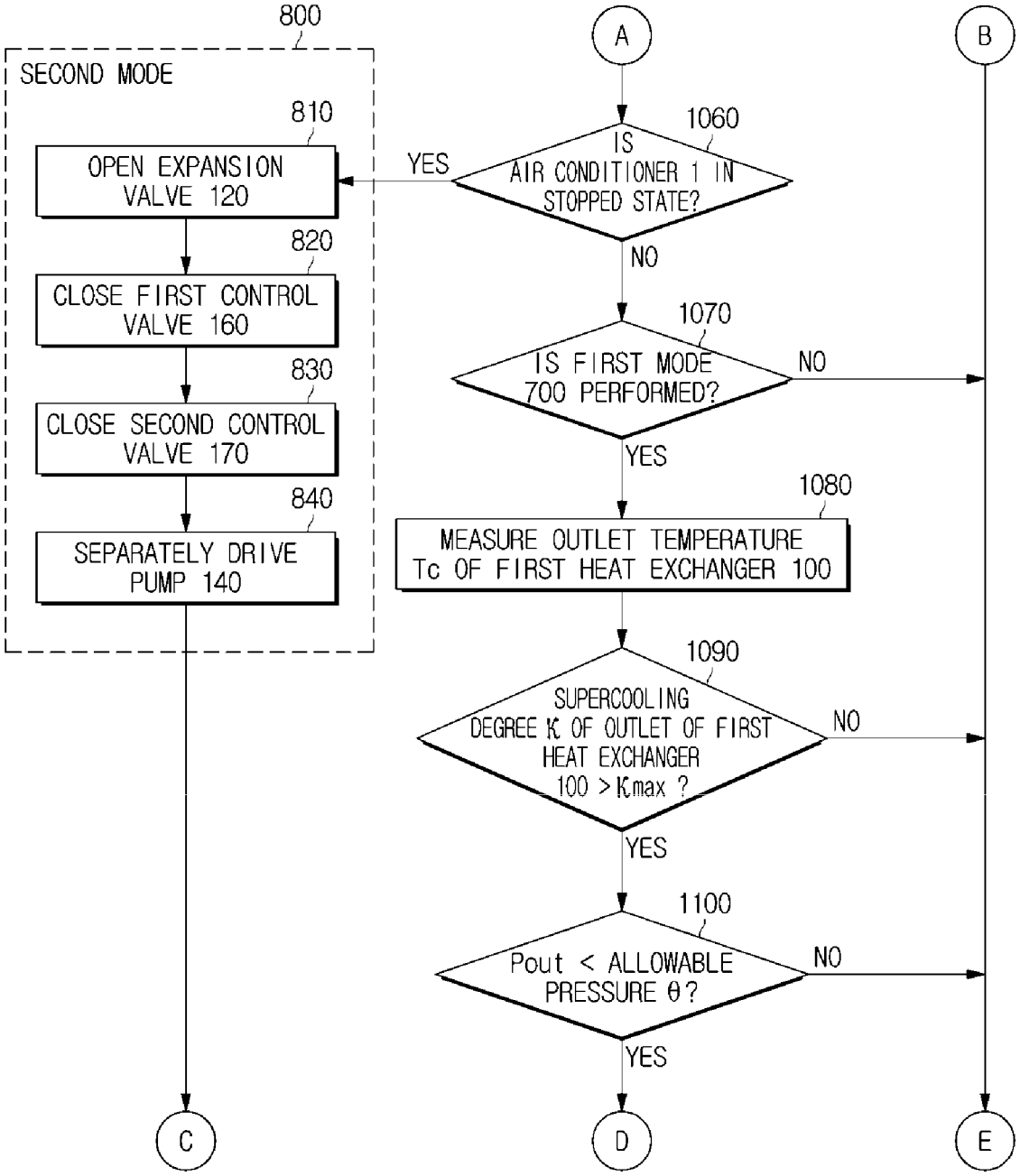

【Fig. 5c】
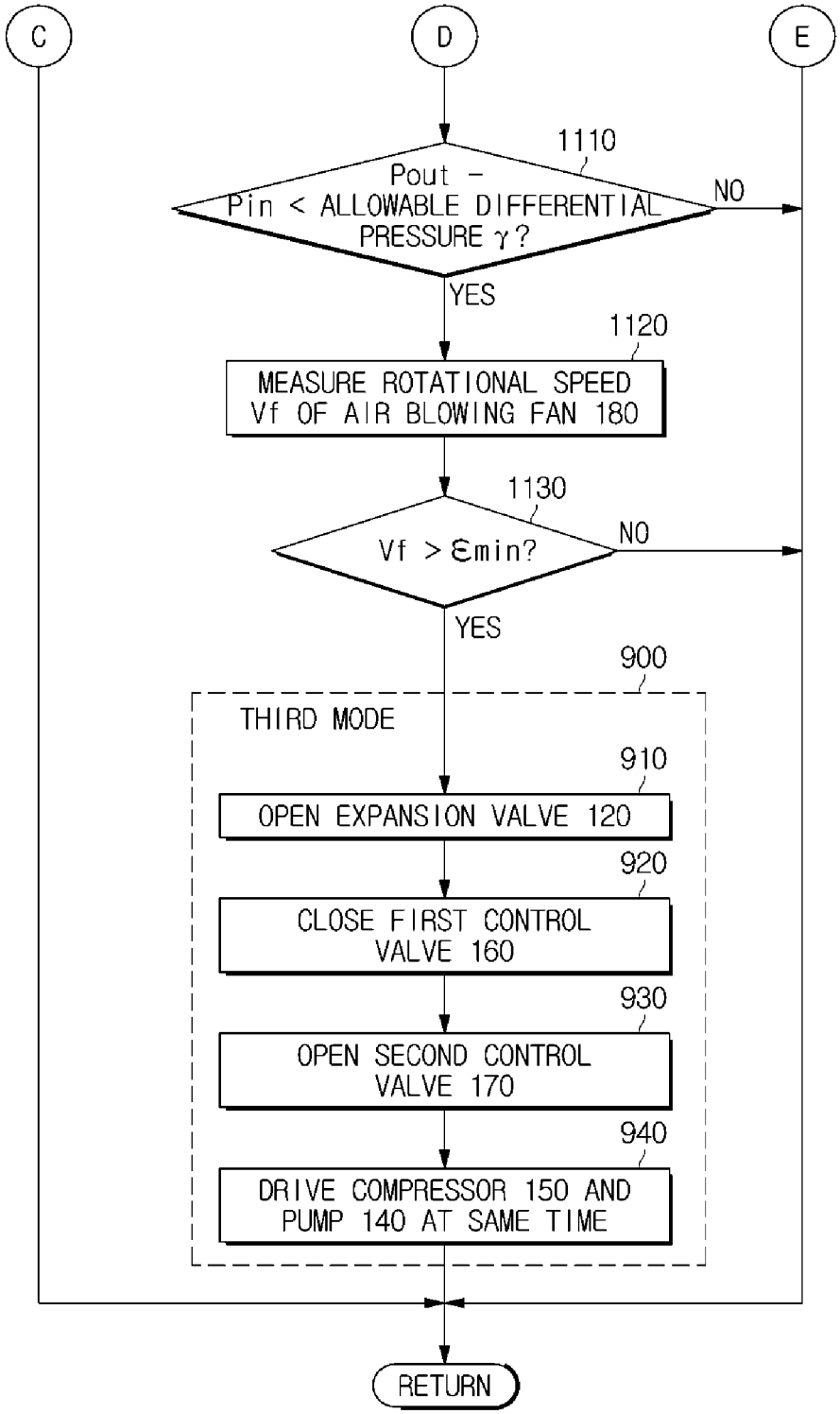

【Fig. 6】
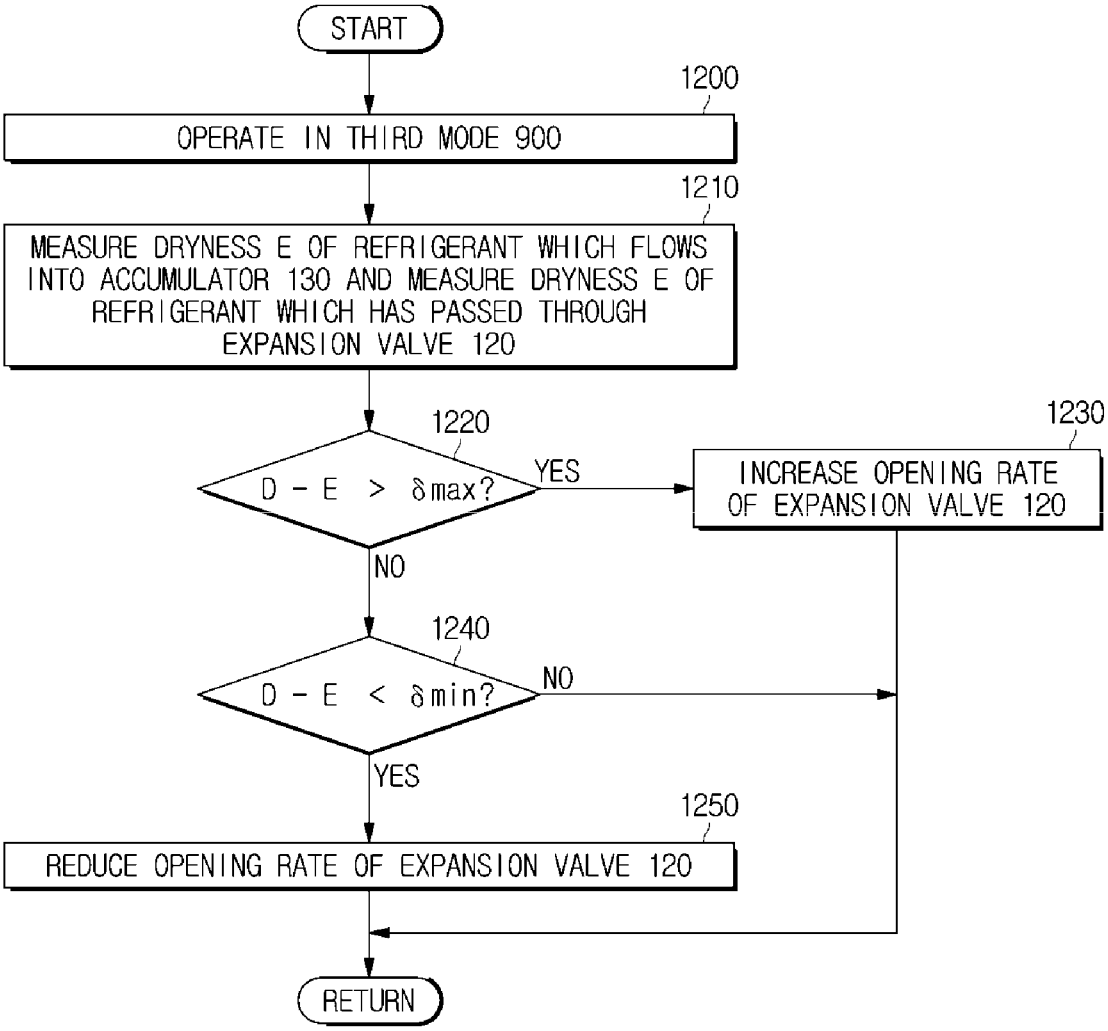

【Fig. 7】
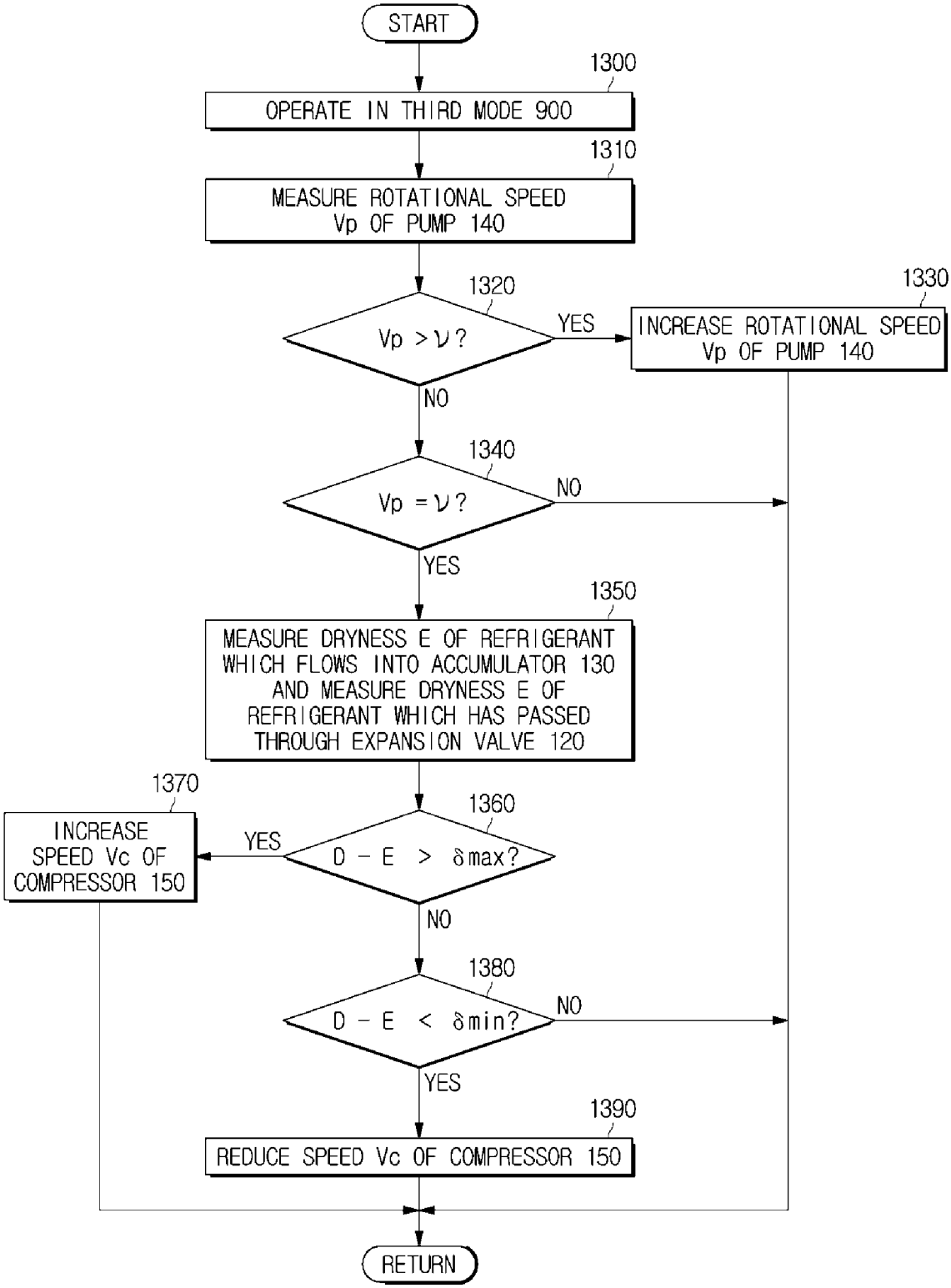

【Fig. 8】
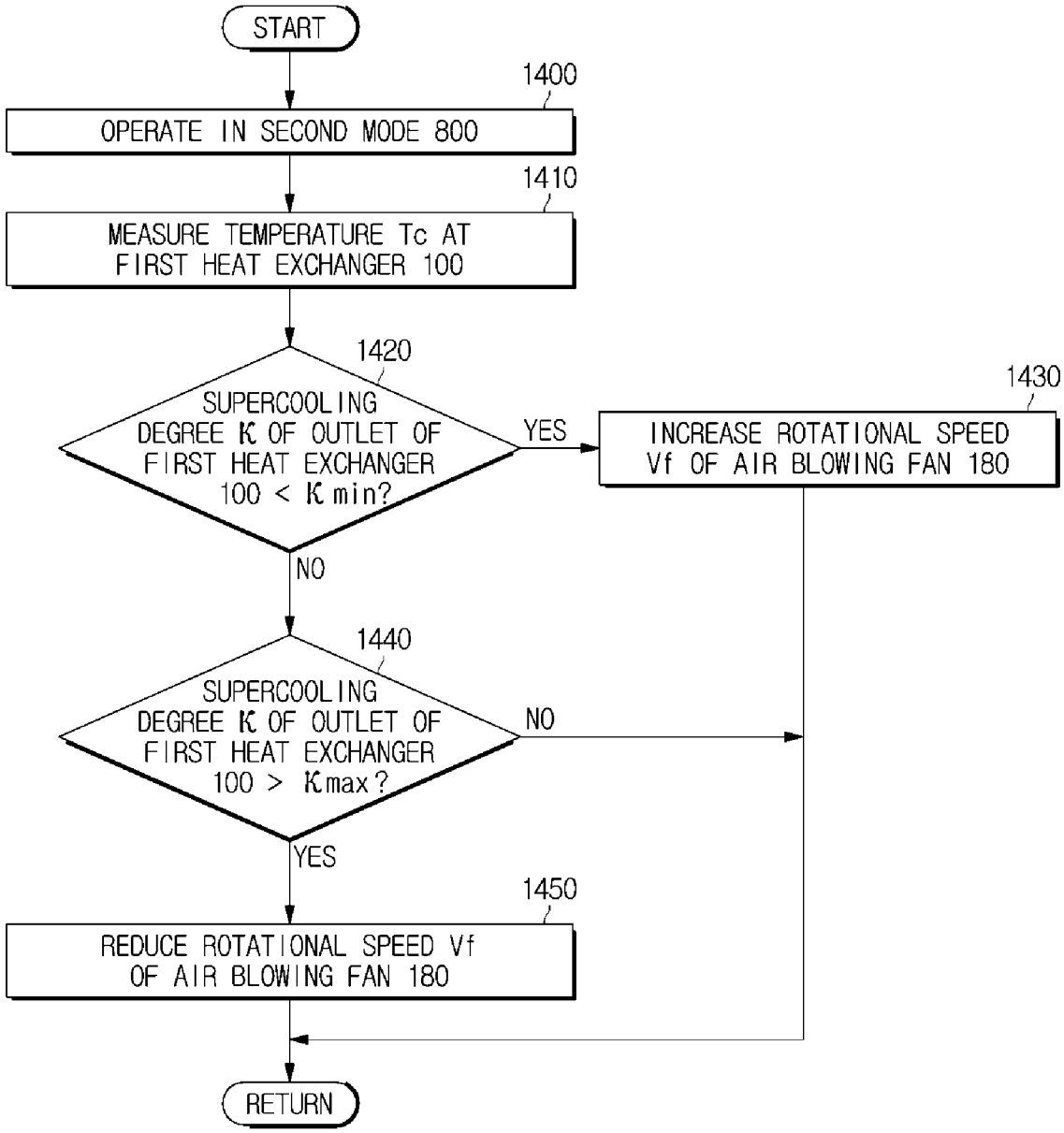

【Fig. 9】
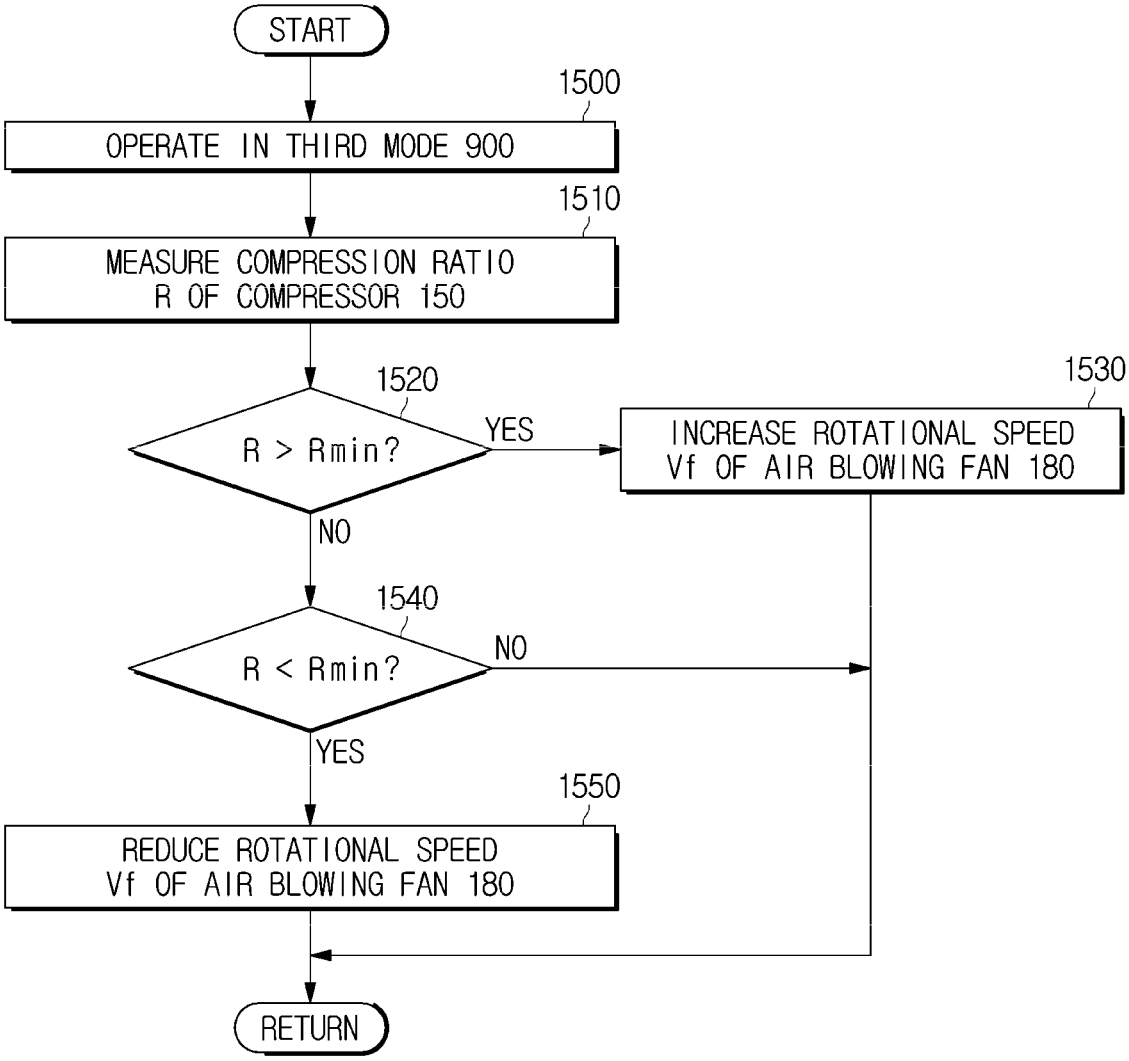

【Fig. 10】
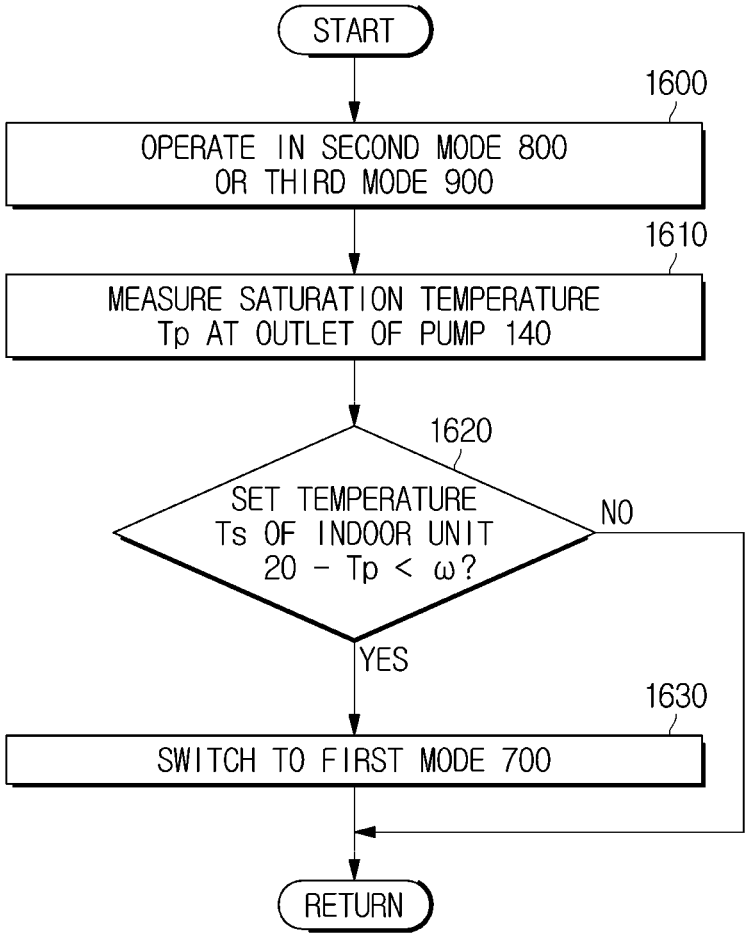

【Fig. 11】
2
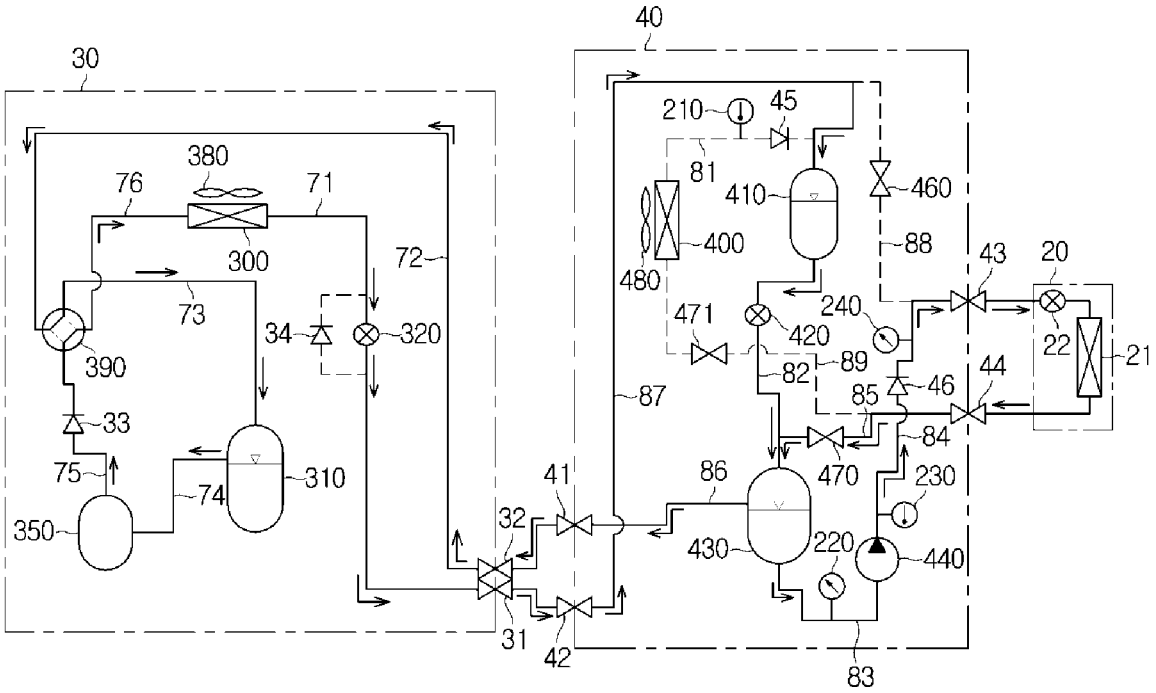

【Fig. 12】
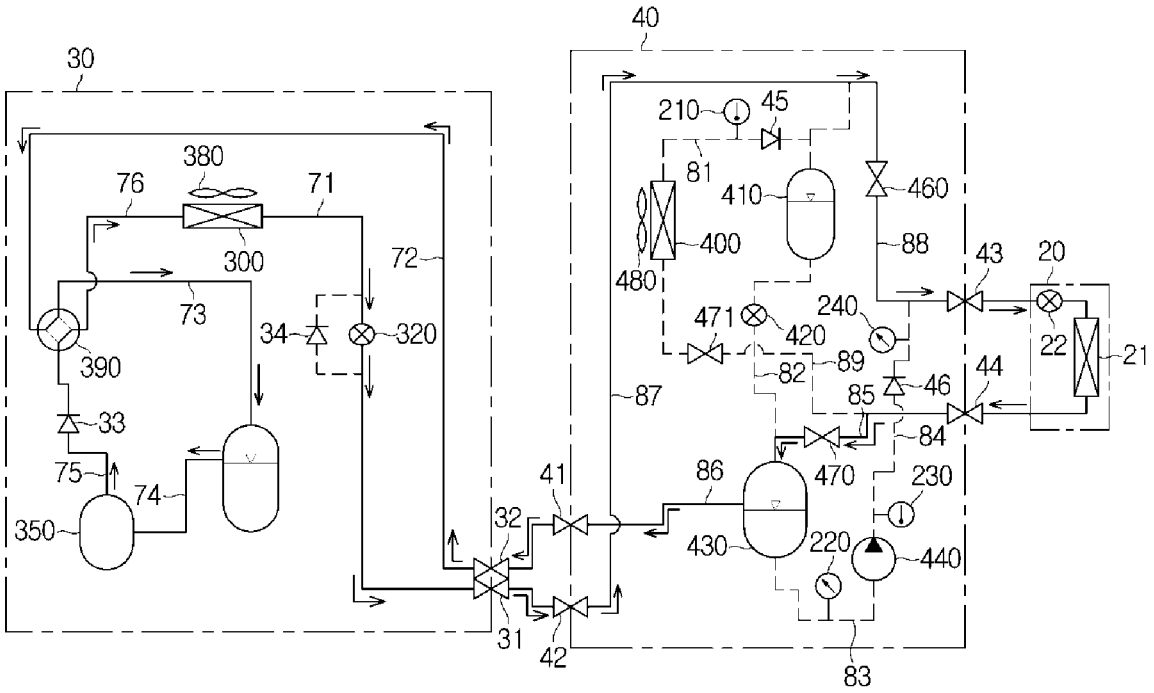

【Fig. 13】
2
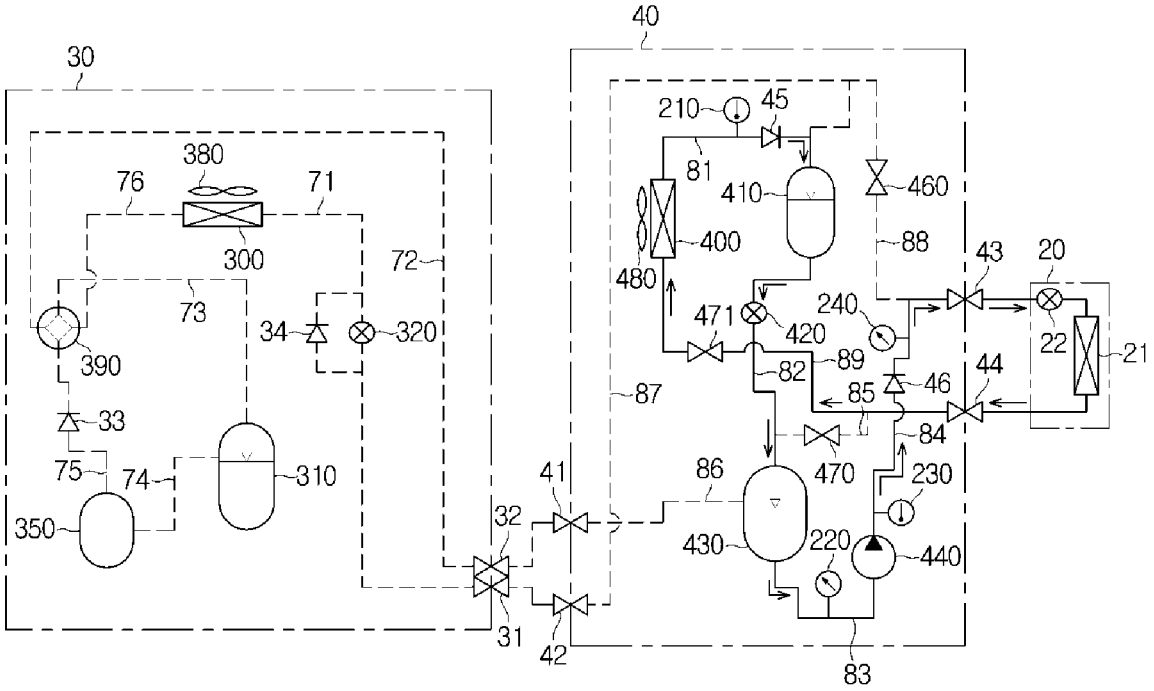

【Fig. 14】
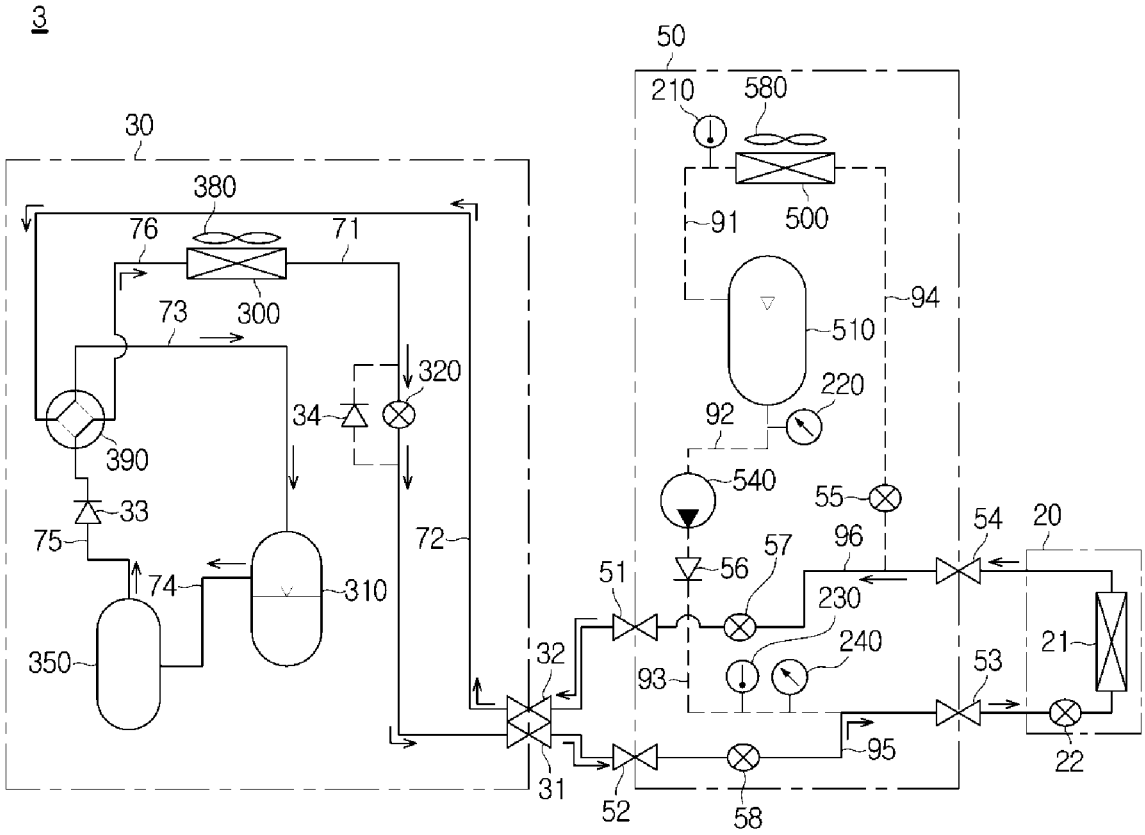

【Fig. 15】
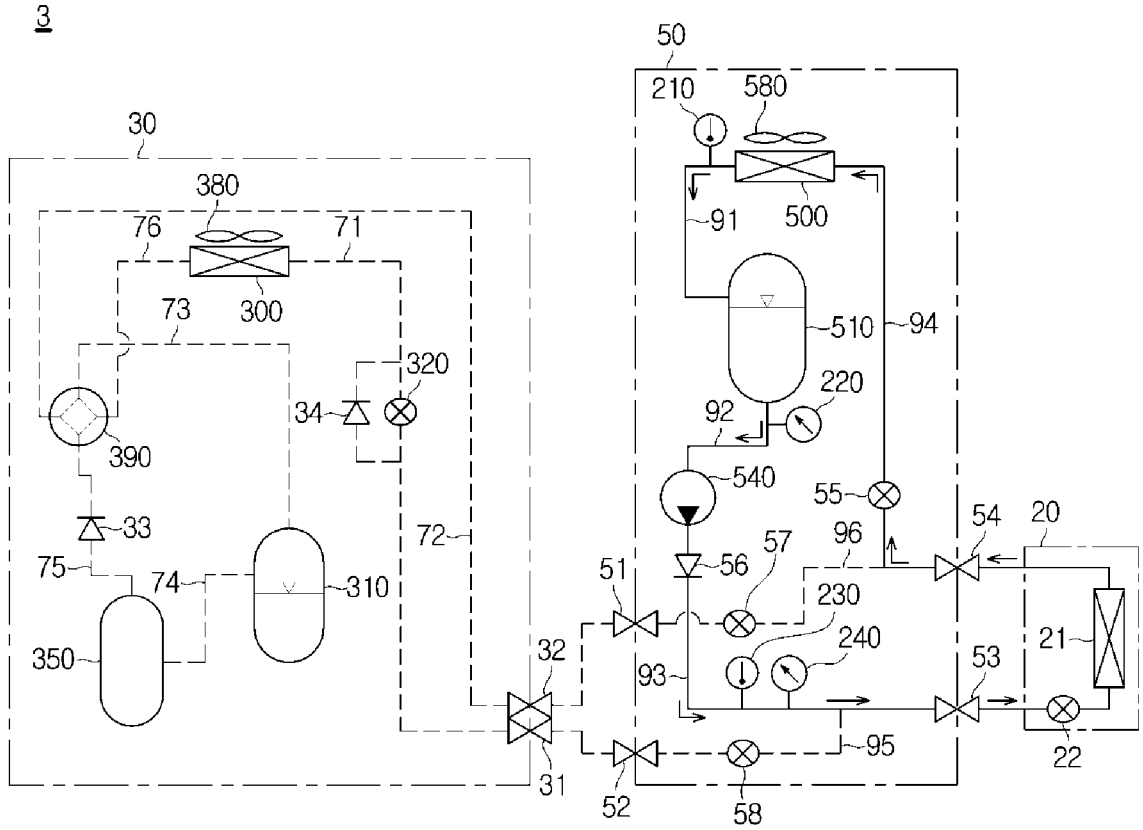

AIR CONDITIONER AND CONTROL METHOD THEREFOR

CROSS-REFERENCE TO RELATED APPLICATIONS

This application is a U.S. National Stage Application which claims the benefit under 35 U.S.C. § 371 of International Patent Application No. PCT/KR2016/011631, filed on Oct. 17, 2016, which claims the priority benefit of Korean Patent Application No. 10-2015-0146020, filed on Oct. 20, 2015 in the Korean Patent and Trademark Office, the disclosures of which are hereby incorporated by reference in their entirety.

TECHNICAL FIELD

The present invention relates to an air conditioner capable of stably performing a cooling operation in an environment in which an outdoor temperature is lower than an indoor temperature.

BACKGROUND ART

Generally, an air conditioner is an apparatus which adjusts temperatures and humidity of indoor air using a refrigeration cycle and may cool a room by suctioning and heat-exchanging warm air with a low-temperature refrigerant and discharging the cooled air into the room, or on the other hand, may heat a room by suctioning and heat-exchanging an inside low-temperature air with a high-temperature refrigerant and discharging the heated air.

An air condition may include an outdoor unit installed in an outdoor space and an indoor unit installed in an indoor space. The outdoor unit may include a compressor for compressing a refrigerant, an outdoor heat exchanger for heat-exchanging outdoor air with a refrigerant, an air blowing fan, and a variety of pipes which connects the compressor to the indoor unit. The indoor unit may include an indoor heat exchanger for heat-exchanging indoor air with a refrigerant and an expansion device.

The air conditioner may cool or heat the room through a refrigerant cycle which circulates the compressor, the indoor heat exchanger (condenser), the expansion device, and the indoor heat exchanger (evaporator) in forward or reverse directions.

In detailed consideration of the refrigerant cycle, a gas refrigerant compressed by the compressor flows into the outdoor heat exchanger and phase-changes into a liquid refrigerant, heat is released outward while the refrigerant phase-changes at the outdoor heat exchanger, and then the refrigerant discharged from the outdoor heat exchanger expands while passing through the expansion device and flows into the indoor heat exchanger.

Afterward, the liquid refrigerant which flows into the indoor heat exchanger phase-changes into a gas refrigerant. Likewise, the refrigerant phase-changes at the indoor heat exchanger and absorbs outside heat.

As described above, the air conditioner adjust an indoor temperature by discharging air (cold air) heat-exchanged by characteristics in which ambient heat is absorbed when a liquid state refrigerant evaporates or the heat is discharged when a gas state refrigerant is liquefied.

Meanwhile, in a space in which a lot of large-sized servers and electronic equipment are installed, cooling is performed even in winter to stably operate the servers and electronic equipment. Particularly, when an outdoor temperature is low, a condensing temperature of a refrigerant which passes through an outdoor heat exchanger decreases and an evaporating temperature of a refrigerant which passes through an indoor heat exchanger decreases.

Also, a phenomenon in which a liquid refrigerant that flows into a compressor or an indoor heat exchanger freezes occurs and causes unstable operation of an air conditioner and an increase in power consumption from over-operating the compressor.

DISCLOSURE OF THE INVENTION

Technical Problem

One aspect of the present invention provides an air conditioner capable of stably performing a cooling operation in an environment in which an outdoor temperature is lower than an indoor temperature.

Also, one aspect of the present invention provides a method of controlling an air conditioner, capable of efficiently performing a cooling operation in an environment in which an outdoor temperature is lower than an indoor temperature without damaging the air conditioner.

Also, one aspect of the present invention provides an air conditioner configured to mount an additional outdoor unit, including a pump capable of low-temperature cooling, between an outdoor unit and indoor unit of an existing air conditioner.

Technical Solution

In accordance with an aspect of the present disclosure, an air conditioner may include an outdoor unit which comprises a first heat exchanger; an indoor unit which comprises a second heat exchanger; an accumulator configured to separate a refrigerant discharged from the first heat exchanger or the indoor unit into a liquid refrigerant and a gas refrigerant; a compressor configured to compress the gas refrigerant discharged from the accumulator and to supply the compressed gas refrigerant to the first heat exchanger; and a pump configured to pressurize the liquid refrigerant discharged from the accumulator and to supply the pressurized liquid refrigerant to the indoor unit.

In addition, the air conditioner may further include an expansion valve provided at a flow path which connects the first heat exchanger to the accumulator and configured to be adjusted an opening rate according to a supercooling degree of a refrigerant discharged from the first heat exchanger; and a control valve provided at a flow path which connects the indoor unit to the accumulator and configured to be opened when an outdoor temperature is lower, by a reference or more, than an indoor temperature.

In addition, the air conditioner may further include a reservoir provided at a flow path, which connects the first heat exchanger to the expansion valve, to store a refrigerant.

In addition, the air conditioner may further include a first check valve configured to allow a refrigerant flow from the compressor to the first heat exchanger; and a second check valve configured to allow a refrigerant flow from the pump to the outdoor unit.

In addition, the air conditioner may further include a bypass flow path which connects the first heat exchanger to the indoor unit to prevent a refrigerant from passing through the pump and at which a control valve configured to adjust a refrigerant flow is provided.

In addition, the air conditioner may further include a bypass flow path which connects the indoor unit to the first heat exchanger to prevent a refrigerant from passing through the compressor and at which a check valve configured to allow a refrigerant flow from the indoor unit to the first heat exchanger is provided.

In accordance with an aspect of the present disclosure, an air conditioner includes an outdoor unit which includes a first heat exchanger, a compressor, an accumulator, and a pump, an indoor unit which includes a second heat exchanger, a first flow path configured to connect the first heat exchanger to the indoor unit and at which the accumulator configured to divide a refrigerant discharged from the indoor unit into a liquid and a gas is provided and the pump configured to pressurize a liquid refrigerant discharged from the accumulator and supply the pressurized liquid refrigerant to the indoor unit, a second flow path configured to connect the indoor unit to the first heat exchanger and at which the accumulator configured to divide a refrigerant discharged from the first heat exchanger or the indoor unit into a liquid and a gas is provided and the compressor configured to compress a gas refrigerant discharged from the accumulator and supply the compressed gas refrigerant to the first heat exchanger is provided, a first bypass flow path configured to connect the first heat exchanger to the indoor unit not to allow a refrigerant to pass through the pump, a second bypass flow path configured to connect the indoor unit to the first heat exchanger not to allow a refrigerant to pass through the compressor, and a controller configured to allow a refrigerant to flow through one of the first flow path and the first bypass flow path and one of the second flow path and the second bypass flow path.

When an outdoor temperature is lower than an indoor temperature by a reference or less, the controller may allow a refrigerant to flow through the first flow path and the second flow path, may switch a refrigerant which is flowing through the first bypass flow path and the second flow path to flow through the first flow path and the second flow path, or may switch a refrigerant which is flowing through the first flow path and the second flow path to flow through the first flow and the second bypass flow path.

The air conditioner may include a first pressure sensor and a second pressure sensor at an outlet side and an inlet side of the pump provided at the first flow path. Here, when a difference between pressures detected by the first pressure sensor and the second pressure sensor is a lower limit or more of a reference range, the controller may flow a refrigerant to flow through the first flow path and the second flow path, may switch a refrigerant which is flowing through the first bypass flow path and the second flow path to flow through the first flow path and the second flow path, or may switch a refrigerant which is flowing through the first flow path and the second flow path to flow through the first flow and the second bypass flow path.

When the pressure detected by the first sensor is an allowable pressure or less of the pump, the controller may switch a refrigerant which is flowing through the first bypass flow path and the second flow path to flow through the first flow path and the second flow path.

The air conditioner may further include a temperature sensor provided at an outlet of the first heat exchanger. Here, when a supercooling temperature of a refrigerant at the outlet of the first heat exchanger exceeds an upper limit of a reference range, the controller may switch the refrigerant which is flowing through the first bypass flow path and the second flow path to flow through the first flow path and the second flow path.

The outdoor unit may further include an air blowing fan configured to suction air into the first heat exchanger and a sensor capable of measuring a rotational speed of the air blowing fan. Here, when the rotational speed of the air blowing fan is below a lower limit of a reference range, the controller may switch a refrigerant which is flowing through the first bypass flow path and the second flow path to flow through the first flow path and the second flow path.

In accordance with an aspect of the present disclosure, a method of controlling an air conditioner in a cooling operation of the air conditioner, which includes an outdoor unit having a first heat exchanger, a compressor and a pump and an indoor unit having a second heat exchanger, may include a first mode in which a refrigerant circulates through the first heat exchanger, the compressor, and the indoor unit; a second mode in which a refrigerant circulates through the first heat exchanger, the pump, and the indoor unit; and a third mode in which a refrigerant circulates through the first heat exchanger, the compressor, the pump, and the indoor unit.

Here, the first mode may include closing an expansion valve provided at a first flow path, at which the pump is provided, to prevent a refrigerant discharged from the first heat exchanger from flowing through the first flow path; opening a first control valve provided at a first bypass flow path connected to the indoor unit to allow a refrigerant discharged from the first heat exchanger to flow through the first bypass flow path; and opening a second control valve provided at a second flow path, at which the compressor is provided, to allow a refrigerant discharged from the indoor unit to flow through the second flow path instead of flowing through a second bypass flow path which directly connects the indoor unit to the first heat exchanger.

In addition, the second mode may include opening an expansion valve provided at a first flow path, at which the pump is provided, to allow a refrigerant discharged from the first heat exchanger to flow through the first flow path; closing a first control valve provided at a first bypass flow path connected to the indoor unit, to prevent a refrigerant discharged from the first heat exchanger from flowing through the first bypass flow path; and closing a second control valve provided at a second flow path, at which the compressor is provided, to allow a refrigerant discharged from the indoor unit to flow through a second bypass flow path which directly connects the indoor unit to the first heat exchanger instead of flowing through the second flow path.

In addition, the third mode may include opening an expansion valve provided at a first flow path, at which the pump is provided, to allow a refrigerant discharged from the first heat exchanger to flow through the first flow path; closing a first control valve provided at a first bypass flow path connected to the indoor unit, to prevent a refrigerant discharged from the first heat exchanger from flowing through the first bypass flow path; and opening a second control valve provided at a second flow path, at which the compressor is provided, to allow a refrigerant discharged from the indoor unit to flow through the second flow path instead of flowing through a second bypass flow path which directly connects the indoor unit to the first heat exchanger.

The method may further include determining whether an outdoor temperature is lower, by a reference or more, than an indoor temperature; and measuring a pressure at an outlet of the pump and a pressure at an inlet of the pump after performing test operation of the pump for a certain period of time or more. When the outdoor temperature is lower, by the reference or more, than the indoor temperature and a difference between the pressure at the outlet of the pump and the pressure at the inlet thereof is equal to or above a lower limit of a reference range, the method is able to operate the air conditioner in the second mode when the air conditioner is in a stopped state or to switch to the third mode when the air conditioner is operating in the first mode.

In addition, when the air conditioner operates in the first mode, the method may further include measuring a temperature of a refrigerant at an outlet of the first heat exchanger and measuring a pressure at the inlet of the pump and a pressure at the outlet of the pump. When a supercooling degree of the refrigerant at the outlet of the first heat exchanger is above an upper limit of a reference range, the pressure at the outlet of the pump is equal to and lower than an allowable pressure of the pump, and the difference between the pressures at the inlet and outlet of the pump is equal to and lower than an allowable differential pressure of the pump, the method is able to switch to the third mode.

In addition, when the air conditioner operates in the first mode, the method may further include measuring a rotational speed of an air blowing fan which allows air to flow into the first heat exchanger. When the rotational speed of the air blowing fan is below a lower limit of a reference range, the method is able to switch to the third mode.

In addition, the air conditioner may further include an accumulator configured to divide a refrigerant discharged from the first heat exchanger and a refrigerant discharged from the indoor unit into a liquid and a gas and supply the liquid and the gas to the pump and the compressor. Here, the method may include calculating dryness of a refrigerant which flows into the accumulator and dryness of a refrigerant which is discharged from the first heat exchanger and passes through the expansion valve when the air conditioner operates in the third mode, increasing an opening rate of the expansion valve provided at a flow path configured to connect the first heat exchanger to the accumulator when a difference between the dryness of the refrigerant which flows into the accumulator and the dryness of the refrigerant which is discharged from the first heat exchanger and passes through the expansion valve exceeds an upper limit of a reference range, reducing the opening rate of the expansion valve when the difference between the dryness of the refrigerant which flows into the accumulator and the dryness of the refrigerant which is discharged from the first heat exchanger and passes through the expansion valve is below a lower limit of the reference range.

In addition, the method may include increasing a rotational speed of the pump when the rotational speed of the pump is lower than a rotational speed limit of the pump and a greater load is put on the air conditioner while the air conditioner operates in the third mode.

In addition, the method may include calculating the dryness of the refrigerant which flows into the accumulator and the dryness of the refrigerant which is discharged from the first heat exchanger and passes through the expansion valve when the pump rotates at the rotational speed limit, increasing a speed of the compressor when the difference between the dryness of the refrigerant which flows into the accumulator and the dryness of the refrigerant which is discharged from the first heat exchanger and passes through the expansion valve exceeds the upper limit of the reference range, and reducing the speed of the compressor when the difference between the dryness of the refrigerant which flows into the accumulator and the dryness of the refrigerant which is discharged from the first heat exchanger and passes through the expansion valve is below the lower limit of the reference range.

In addition, when the air conditioner operates in the second mode, the method may further include measuring a temperature of a refrigerant at an outlet of the first heat exchanger. When a supercooling degree of the refrigerant at the outlet of the first heat exchanger is below a lower limit of a reference range, the method is able to increase a rotational speed of an air blowing fan which allows air to flow into the first heat exchanger. When the supercooling degree of the refrigerant at the outlet of the first heat exchanger is above an upper limit of the reference range, the method is able to reduce the rotational speed of the air blowing fan.

In addition, the method may include determining whether a compression ratio of the compressor exceeds a minimum compression ratio when the air conditioner operates in the third mode, increasing the rotational speed of the air blowing fan when the compression ratio of the compressor exceeds the minimum compression ratio, and reducing the rotational speed of the air blowing fan when the compression ratio of the compressor is below the minimum compression ratio.

In addition, when the air conditioner operates in the second mode or the third mode, the method is able to switch to the first mode when a difference between a set temperature of the indoor unit and a saturation temperature of the outlet of the pump is below a lower limit of a reference range.

In accordance with another aspect of the present disclosure, an air conditioner includes a first outdoor unit which includes a first heat exchanger and a compressor, an indoor unit which includes a second heat exchanger, an accumulator configured to divide a refrigerant discharged from the first outdoor unit or the indoor unit into a liquid and a gas, and a second outdoor unit which includes a pump configured to pressurize a liquid refrigerant discharged from the accumulator and supply the pressurized liquid refrigerant to the indoor unit. Here, a gas refrigerant discharged from the accumulator may be supplied to the first outdoor unit.

Here, the second outdoor unit may further include a third heat exchanger configured to heat-exchange a refrigerant discharged from the indoor unit and a bypass flow path configured to connect the indoor unit to the third heat exchanger not to allow the refrigerant to pass through the compressor of the first outdoor unit and at which a control valve capable of adjusting a flow of the refrigerant which moves from the indoor unit toward the first heat exchanger is provided.

In addition, the second outdoor unit may include a bypass flow path configured to connect the first outdoor unit to the indoor unit not to allow a refrigerant to pass through the pump and at which a control valve configured to adjust a refrigerant flow.

In accordance with still another aspect of the present disclosure, an air conditioner includes a first outdoor unit which includes a first heat exchanger and a compressor, an indoor unit which includes a second heat exchanger, and a second outdoor unit disposed between the first outdoor unit and the indoor unit to receive a refrigerant from the first outdoor unit and supply the refrigerant to the indoor unit or to receive a refrigerant from the indoor unit and supply the refrigerant to the first outdoor unit. Here, the second outdoor unit may include a third heat exchanger configured to heat-exchange the refrigerant discharged from the indoor unit, an accumulator configured to divide a refrigerant discharged from the third heat exchanger into a liquid or a gas, and a pump configured to pressurize a liquid refrigerant discharged from the accumulator and supply the pressurized liquid refrigerant to the indoor unit.

Here, the second outdoor unit may further include a first transfer flow path configured to connect the first outdoor unit to the indoor unit to receive a refrigerant from the first outdoor unit and supply the refrigerant to the indoor unit and a second transfer flow path configured to connect the indoor unit to the first outdoor unit not to allow a refrigerant discharged from the indoor unit to pass through the third heat exchanger, the accumulator, and the pump.

Advantageous Effects

Since an air conditioner according to the concept of the present invention includes both a compressor capable of compressing and circulating a gas state refrigerant, and a pump capable of pressurizing and circulating a liquid state refrigerant, the air conditioner may stably perform a cooling operation even in an environment in which an outdoor temperature is lower than an indoor temperature.

Also, in a method of controlling an air conditioner according to the concept of the present invention, when operation efficiency of a compressor decreases in an environment in which an outdoor temperature is lower than an indoor temperature, a pump is operated simultaneously or only the pump is separately operated such that the air conditioner may efficiently perform a cooling operation without discontinuities of a cooling function, and the compressor and the pump may be prevented from being damaged by controlling a refrigerant flow.

Also, in the air conditioner according to the concept of the present invention, since an outdoor unit which includes a pump may be mounted on an existing outdoor unit for low-temperature cooling, a low-temperature cooling system may be embodied utilizing the existing outdoor unit.

BRIEF DESCRIPTION OF THE DRAWINGS

FIG. 1 is a view illustrating a state in which a compressor and a pump of an air conditioner according to one embodiment of the present invention are driven simultaneously FIG. 2 is a view illustrating a state in which only the compressor of the air conditioner shown in FIG. 1 is driven.

FIG. 3 is a view illustrating a state in which only the pump of the air conditioner shown in FIG. 1 is driven.

FIG. 4 is a control block diagram of the air conditioner shown in FIG. 1.

FIGS. 5*a* to 5*c* are flowcharts illustrating methods of operating the air conditioner shown in FIG. 1 in the first mode, the second mode, and third mode.

FIG. 6 is a flowchart illustrating a method of controlling the expansion valve while the air conditioner shown in FIG. 1 operates in the third mode.

FIG. 7 is a flowchart illustrating a method of controlling the compressor or the pump while the air conditioner shown in FIG. 1 operates in the third mode.

FIG. 8 is a flowchart illustrating a method of controlling the air blowing fan while the air conditioner shown in FIG. 1 operates in the second mode.

FIG. 9 is a flowchart illustrating a method of controlling the air blowing fan while the air conditioner shown in FIG. 1 operates in the third mode.

FIG. 10 is a flowchart illustrating a method of controlling the air conditioner shown in FIG. 1 such that the air conditioner, which operates in the second mode or the third mode, is switched to the first mode.

FIG. 11 is a view illustrating a state in which a compressor and a pump of the air conditioner according to another embodiment of the present invention are driven simultaneously.

FIG. 12 is a view illustrating a state in which only a compressor of the air conditioner shown in FIG. 11 is driven.

FIG. 13 is a view illustrating a state in which only a pump of the air conditioner shown in FIG. 11 is driven.

FIG. 14 is a view illustrating a state in which only a compressor of the air conditioner according to still another embodiment of the present invention is driven.

FIG. 15 is a view illustrating a state in which only a pump of the air conditioner shown in FIG. 14 is driven.

MODE FOR CARRYING OUT THE INVENTION

Embodiments described herein and configurations shown in the drawings are merely exemplary examples. Also, various modified examples with which these embodiments and the drawings could be replaced may be present at the time of filing of the present application.

Also, throughout the drawings of the specification, the same reference numerals or symbols refer to components or elements which perform substantially same functions.

Also, the terms used herein explain the embodiments but are not intended to restrict and/or limit the present disclosure. Singular expressions, unless clearly defined otherwise in context, include plural expressions. Throughout the specification, the terms "comprise," "include," "have", and the like are used herein to specify the presence of stated features, numbers, steps, operations, elements, components or combinations thereof but do not preclude the presence or addition of one or more other features, numbers, steps, operations, elements, components, or combinations thereof.

Also, even though the terms including ordinals such as "first", "second", and the like may be used to describe various components, the components are not be limited by the terms and the terms are used only for distinguishing one element from others. For example, without departing from the scope of the present disclosure, a first component may be referred to as a second component, and similarly, a second component may be referred to as a first component. The term "and/or" includes any and all combinations of one or a plurality of associated listed items.

Hereinafter, an air conditioner and a method of controlling the same according to one embodiment of the present invention will be described with reference to the attached drawings.

FIG. 1 is a view illustrating a state in which a compressor and a pump of an air conditioner according to one embodiment of the present invention are driven simultaneously, FIG. 2 is a view illustrating a state in which only the compressor of the air conditioner shown in FIG. 1 is driven, and FIG. 3 is a view illustrating a state in which only the pump of the air conditioner shown in FIG. 1 is driven. Also, FIG. 4 is a control block diagram of the air conditioner shown in FIG. 1.

Referring to FIGS. 1 to 3, an air conditioner 1 according to one embodiment of the present invention includes an outdoor unit 10 including a first heat exchanger 100 and an indoor unit 20 including a second heat exchanger 21. Generally, in a cooling operation, the first heat exchanger 100 included in the outdoor unit 10 is used as a condenser and the second heat exchanger 21 included in the indoor unit 20 is used as an evaporator.

The air conditioner 1 may include a compressor 150 and an expansion device 22, which form a refrigeration cycle. The compressor 150 may be included in the outdoor unit 10 and the expansion device 22 may be included in the indoor unit 20.

Also, the air conditioner 1 may further include a pump 140 for efficiently operating the air conditioner 1 when an outdoor temperature of a place where the outdoor unit 10 is installed, is lower, by a certain degree or more, than an indoor temperature of a place where the indoor unit 20 is installed.

Also, the air conditioner 1 may include an accumulator 130 capable of separating a refrigerant discharged from the first heat exchanger 100 of the outdoor unit 10 or the second heat exchanger 21 of the indoor unit 20 into a liquid and a gas and the supplying the liquid and gas to the compressor 150 and the pump 140.

A gaseous refrigerant collected at the accumulator 130 is supplied to the compressor 150 through a flow path 66 which connects an outlet provided at a top of the accumulator 130 to the compressor 150, and a liquid refrigerant collected at the accumulator 130 is supplied to the pump 140 through a flow path 63 which connects an outlet provided at a bottom of the accumulator 130 to the pump 140.

The compressor 150 may compress the gaseous refrigerant discharged from the accumulator 130 and supply the compressed gaseous refrigerant to the first heat exchanger 100 of the outdoor unit 10, and the pump 140 may pressurize the liquid refrigerant discharged from the accumulator 130 and supply the pressurized liquid refrigerant to the indoor unit 20.

An expansion valve 120 which adjusts an opening rate according to a supercooling degree of a refrigerant discharged from the first heat exchanger 100 may be provided at flow paths 61 and 62 which connect the first heat exchanger 100 to the accumulator 130, and a control valve 170 which is opened when an outdoor temperature is lower, by a reference value or more, than an indoor temperature and it is necessary to drive the compressor 150 and the pump 140 simultaneously may be provided at a flow path 65 which connects the indoor unit 20 to the accumulator 130, that is, the flow path 65 which connects an inlet valve 12 of the outdoor unit 10, through which the refrigerant flows from the indoor unit 20 to the outdoor unit 10, to the accumulator 130.

Also, a reservoir 110 capable of storing a liquid refrigerant which will be discharged from the first heat exchanger 100 and pressurized by the pump 140 may be provided at the flow path 61 which connects the first heat exchanger 100 to the expansion valve 120, and a liquid level sensor (not shown) capable of checking an amount of the liquid refrigerant stored at the reservoir 110 may be provided at the reservoir 110.

Also, a first check valve 14 which allows a refrigerant to flow from the compressor 150 to the first heat exchanger 100, may be provided at a flow path 67 which connects the compressor 150 to the first heat exchanger 100, and a second check valve 15 which allows a refrigerant to flow from the pump 140 to the indoor unit 20 may be provided at a flow path 64 which connects the pump 140 to the outdoor unit 10, that is, the flow path 64 which connects an outlet valve 11 of the outdoor unit 10, through which a refrigerant flows from the outdoor unit 10 to the indoor unit 20, to the pump 140.

The air conditioner 1 may further include a first bypass flow path 68 so as to perform a cooling operation using only the compressor 150 without using the pump 140 when a normal cooling operation is necessary rather than a low-temperature cooling case in which an outdoor temperature is lower than an indoor temperature. The first bypass flow path 68 connects the first heat exchanger 100 to the indoor unit 20 or the outlet valve 11 of the outdoor unit 10 to prevent a refrigerant from passing through the pump 140, and a control valve 160 capable of adjusting a refrigerant flow may be provided at the first bypass flow path 68.

Also, the air conditioner 2 may further include a second bypass flow path 69 so as to perform a cooling operation using only the pump 140 without using the compressor 150 when an outdoor temperature is lower than an indoor temperature and a low-temperature cooling operation is performed. The second bypass flow path 69 connects the indoor unit 20 or the inlet valve 12 of the outdoor unit 10 to the first heat exchanger 100, and a check valve 13 which allows a refrigerant which flows from the indoor unit 20 to the first heat exchanger 100 to flow may be provided at the second bypass flow path 69.

Also, the outdoor unit 10 may include an air blowing fan 180 which is provided at the first heat exchanger 100 and helps heat exchange at the first heat exchanger 100 by allowing air to flow into the first heat exchanger 100.

Hereinafter, the air conditioner 1 according to one embodiment of the present invention will be described according to a refrigerant flow.

Referring to FIGS. 1 to 3, the air conditioner 1 may include first flow paths 61, 62, 63, and 64 which connect the first heat exchanger 100 to the indoor unit 20 and at which the accumulator 130 and the pump 140 are provided, and second flow paths 65, 66, and 67 which connect the indoor unit 20 to the first heat exchanger 100 and at which the accumulator 130 and the compressor 150 are provided.

At the accumulator 130 at which the first flow paths intersect with the second flow paths, a gaseous refrigerant of a refrigerant which flows from the first heat exchanger 100 to the accumulator 130 may mixedly flow into the second flow paths, and a liquid refrigerant of a refrigerant which flows from the indoor unit 20 to the accumulator 130 may mixedly flow into the first flow paths.

Also, the air conditioner 1 may include the first bypass flow path 68 which diverges from the flow path 61, which connects the first heat exchanger 100 to the expansion valve 120 to prevent the refrigerant discharged from the first heat exchanger 100 from passing through the pump 140, and directly connects the first heat exchanger 100 to the indoor unit 20 and may include the second bypass flow path 69 which diverges from the flow path 65, which connects the indoor unit 20 to the accumulator 130 to prevent the refrigerant discharged from the indoor unit 20 from passing through the compressor 150, and directly connects the indoor unit 20 to the first heat exchanger 100.

Also, the air conditioner 1 may include a controller 600 capable of allowing a refrigerant to flow through one of the first flow paths 61, 62, 63, and 64 which pass the pump 140 and the first bypass flow path 68 which does not pass the pump 140 and capable of allowing a refrigerant to flow through one of the second flow paths 65, 66, and 67 which pass the compressor 150 and the second bypass flow path 69 which does not pass the compressor 150.

Referring to FIGS. 1 to 4, the air conditioner 1 may include a sensor 250 for measuring an outdoor temperature Tout and a sensor 260 for measuring an indoor temperature Tin. When the indoor temperature Tin is lower, by a reference value or more, than the outdoor temperature Tout, the controller 600 may move a refrigerant to the first flow paths 61, 62, 63, and 64 and the second flow paths 65, 66, and 67, may switch the refrigerant which is flowing through the first bypass flow path 68 and the second flow paths 65, 66, and 67 to flow through the first flow paths 61, 62, 63, and 64 and the second flow paths 65, 66, and 67, or may switch the refrigerant which is flowing through the first flow paths 61, 62, 63, and 64 and the second flow paths 65, 66, and 67 to flow through the first flow paths 61, 62, 63, and 64 and the second bypass flow path 69.

Also, the air conditioner 1 may include a first pressure sensor 240 and a second pressure sensor 220 provided at the first flow path 64 connected to an outlet side of the pump 140 and provided at the first flow path 63 connected to an inlet side of the pump 140, respectively. When a difference between an outlet pressure Pout of the pump 140 detected by the first pressure sensor 240 and an inlet pressure Pin of the pump 140 detected by the second pressure sensor 220 is above a lower limit of a reference range, the controller 600 may move a refrigerant to the first flow paths 61, 62, 63, and 64 and the second flow paths 65, 66, and 67, may switch the refrigerant which is flowing through the first bypass flow path 68 and the second flow paths 65, 66, and 67 to flow through the first flow paths 61, 62, 63, and 64 and the second flow paths 65, 66, and 67, or may switch the refrigerant which is flowing through the first flow paths 61, 62, 63, and 64 and the second flow paths 65, 66, and 67 to flow through the first flow paths 61, 62, 63, and 64 and the second bypass flow path 69.

Here, when a refrigerant of the air conditioner 1 is already flowing through the first bypass flow path 68 and the second flow paths 65, 66, and 67, so as to switch a flow of the refrigerant to the first flow paths 61, 62, 63, and 64 and the second flow paths 65, 66, and 67, it is necessary that a pressure of the refrigerant which is flowing through the flow path 68 is equal to or lower than an allowable pressure of the pump 140. Since the flow path 64 connected to the outlet side of the pump 140 is attached to the flow path 68, which directly connects the first heat exchanger to the indoor unit 20, and is connected to the outlet valve 11 of the outdoor unit 10, the first pressure sensor 240 may measure a pressure of a refrigerant which flows to the flow path 68 and the pressure may become the outlet pressure Pout of the pump 140. Accordingly, when the outlet pressure Pout of the pump 140 detected by the first pressure sensor 240 is equal to or lower than the allowable pressure of the pump 140, the pump 140 may be driven without damage and the controller 600 may switch a refrigerant which is flowing through the first bypass flow path 68 and the second flow paths 65, 66, and 67 to flow through the first flow paths 61, 62, 63, and 64 and the second flow paths 65, 66, and 67.

Also, the air conditioner 1 may include a temperature sensor 210 provided at the flow path connected to an outlet side of the first heat exchanger 100. Since a supercooling degree of a refrigerant at the outlet of the first heat exchanger 100 is an index which indicates how much a liquid refrigerant amount capable of being supplied to the pump 140 is included in the refrigerant at the outlet of the first heat exchanger 100, when the supercooling degree of the refrigerant at the outlet of the first heat exchanger 100 is above an upper limit of the reference range on the basis of a temperature Tc detected by the temperature sensor 210 and the refrigerant amount of a reference value or more is secured, the controller may shift a refrigerant which is flowing through the first bypass flow path 68 and the second flow paths 65, 66, and 67 to flow through the first flow paths 61, 62, 63, and 64 and the second flow paths 65, 66, and 67.

Also, the air conditioner 1 may further include a sensor 270 capable of measuring a rotational speed Vf of the air blowing fan 180 provided at the first heat exchanger 100 side. When an outdoor temperature Tout at a place where the outdoor unit 10 is installed, a condensing pressure of a refrigerant at the first heat exchanger 100 is decreased. When the condensing pressure at the first heat exchanger 100 is decreased, an air volume of the air blowing fan 180 is reduced so as to secure a compression ratio at the compressor 150. When the rotational speed Vf of the air blowing fan 180 is decreased to be equal to or below a lower limit of a reference range, it is impossible to perform a cooling operation using only the compressor 150. Accordingly, when the rotational speed Vf of the air blowing fan 180 is decreased to be equal to or below the lower limit of the reference range, the controller 600 may shift a refrigerant which is flowing through the first bypass flow path 68 and the second flow paths 65, 66, and 67 to flow through the first flow paths 61, 62, 63, and 64 and the second flow paths 65, 66, and 67.

The sensor 270 which measures the rotational speed Vf of the air blowing fan 180 may replace measurement of the rotational speed Vf with measurement of power consumption of the air blowing fan 180.

Hereinafter, a method of controlling the air conditioner according to one embodiment of the present invention will be described with reference to FIGS. 1 to 10.

As shown in FIG. 4, the air conditioner 1 may include an input portion 200 which runs a start of a cooling operation or a heating operation from a user. The user may input performing of the cooling operation through the input portion 200 to as well as may input a set temperature Ts which is desired by the user. The input portion 200 may be provided at the indoor unit 20.

When the performing of the cooling operation is received through the input portion 200, the controller 600 may control the expansion valve 120, the first control valve 160 provided at the first bypass flow path 68, the second control valve 170 provided at the second flow paths 65, 66, and 67, the compressor 150, the pump 140, the air blowing fan 180 provided at the first heat exchanger 100, and the like on the basis of data detected by a variety of sensors so as to allow the air conditioner 1 to efficiently operate.

In controlling of the air conditioner according to the present invention, a reference value range of control may be set in consideration of hysteresis and the controller may control the air conditioner with an upper limit and a lower limit of the reference range as critical points.

The method of controlling according to one embodiment of the present invention may include a first mode 700, a second mode 800, or a third mode 900, in which the compressor 150 and/or the pump 140 are driven according to internal and external operation environments of the air conditioner 1.

The first mode 700 is an operation mode in which a refrigerant circulates through the first heat exchanger 100, the compressor 150, and the indoor unit 20 such that only the compressor is separately driven. The second mode 800 is an operation mode in which a refrigerant circulates through the first heat exchanger 100, the pump 140, and the indoor unit 20 such that only the pump 140 is separately driven. The third mode 900 is an operation mode in which a refrigerator circulates through the first heat exchanger 100, the compressor 150, the pump 140, and the indoor unit 20 such that both the compressor 150 and the pump 140 are driven simultaneously.

Each of the operation modes will be described with reference to FIGS. 1 to 3 and 5*a* to 5*c*.

FIG. 2 illustrates circulation of a refrigerant in the first mode 700. In the first mode 700, the expansion valve 120 provided at the first flow paths is closed such that a refrigerant discharged from the first heat exchanger 100 may not flow through the first flow paths 61, 62, 63, and 64 at which the pump 140 is provided (710), the first control valve 160 provided at the first bypass flow path 68 is opened such that the refrigerant discharged from the first heat exchanger 100 may flow through the first bypass flow path 68 (720), and the second control valve 170 provided at the second control flow path 65, 66, and 67 is opened such that the refrigerant discharged from the indoor unit 20 may not flow to the second bypass flow path 69 which directly connects the indoor unit 20 to the first heat exchanger 100 and may flow through the second flow paths 65, 66, and 67 at which the compressor 150 is provided (730), and the only the compressor 150 may be separately driven (740).

FIG. 3 illustrates circulation of a refrigerant in the second mode 800. In the second mode 800, the expansion valve 120 provided at the first flow paths 61, 62, 63, and 64 is opened such that a refrigerant discharged from the first heat exchanger 100 may flow through the first flow paths 61, 62, 63, and 64 at which the pump 140 is provided (810), the first control valve 160 provided at the first bypass flow path 68 is closed such that the refrigerant discharged from the first heat exchanger 100 may not flow through the first bypass flow path 68 (820), and the second control valve 170 provided at the second control flow path 65, 66, and 67 is closed such that the refrigerant discharged from the indoor unit 20 may not flow through the second flow paths 65, 66, and 67 at which the compressor 150 is provided and may flow through the second bypass flow path 69 which directly connects the indoor unit 20 to the first heat exchanger 100 (830), and the only the pump 140 may be separately driven (840).

FIG. 1 illustrates circulation of a refrigerant in the third mode 900. In the third mode 900, the expansion valve 120 provided at the first flow paths 61, 62, 63, and 64 is opened such that a refrigerant discharged from the first heat exchanger 100 may flow through the first flow paths 61, 62, 63, and 64 at which the pump 140 is provided (910), the first control valve 160 provided at the first bypass flow path 68 is closed such that the refrigerant discharged from the first heat exchanger 100 may not flow through the first bypass flow path 68 (920), and the second control valve 170 provided at the second control flow path 65, 66, and 67 is opened such that the refrigerant discharged from the indoor unit 20 may not flow through the second bypass flow path 69 which directly connects the indoor unit 20 to the first heat exchanger 100 and may flow through the second flow paths 65, 66, and 67 at which the compressor 150 is provided (930), and both the compressor 150 and the pump 140 may be driven simultaneously (940).

Hereinafter, the method of controlling the air conditioner 1, which includes the first mode 700, the second mode 800, and the third mode 900, will be described.

FIGS. 5*a* to 5*c* are flowcharts illustrating methods of operating the air conditioner shown in FIG. 1 in the first mode, the second mode, and third mode.

When a cooling operation is input to the input portion 200 by a user (1000), an outdoor temperature Tout and an indoor temperature Tin are measured by the sensor 250 for measuring the outdoor temperature Tout and the sensor 260 for measuring the indoor temperature Tin (1010). It is determined whether the outdoor temperature Tout is lower, by a reference value α or more, than the indoor temperature Tin (1020). When the outdoor temperature Tout is not lower, by the reference value α or more, than the indoor temperature Tin, since it is not a low-temperature cooling environment, the air conditioner 1 performs a normal cooling operation in the first mode 700.

When the outdoor temperature Tout is lower, by the reference value α or more, than the indoor temperature Tin, a test operation of the pump 140 is performed for more than a certain period of time η to check whether a liquid refrigerant amount capable of driving the pump 140 is prepared (1030), and an inlet pressure Pin of the pump 140 and an outlet pressure Pout of the pump 140 are measured by the pressure sensor 220 provided at the inlet of the pump 140 and the pressure sensor 240 provided at the outlet of the pump 140 (1040).

It is determined whether the outlet pressure Pout of the pump 140 and the inlet pressure Pin of the pump 140 are higher than a lower limit βmin of a reference range (1050). When the outlet pressure Pout of the pump 140 and the inlet pressure Pin of the pump 140 are not higher than a lower limit βmin of the reference range, since a liquid refrigerant amount is inadequate, it is impossible to operate the pump 140, and the air conditioner 1 performs operation in the first mode 700.

When the outlet pressure Pout of the pump 140 and the inlet pressure Pin of the pump 140 are higher than the lower limit βmin of the reference range, it is determined whether the air conditioner 1 is in a stopped state (1060). When the air conditioner 1 is in the stopped state in which the air conditioner 1 does not start operating, the air conditioner 1 performs operation in the second mode 800.

When the air conditioner 1 is not in the stopped state and operates in a random operation mode, it is determined whether the air conditioner 1 operates in the first mode 700 (1070). When the air conditioner 1 does not operate in the first mode 700, starting operations of the flowcharts shown in FIGS. 5*a* to 5*c* are performed again and an operation environment of the air conditioner 1 is determined again.

When the air conditioner 1 operates in the first mode 700, a temperature Tc of a refrigerant at the outlet of the first heat exchanger 100 is measured by the temperature sensor 210 provided at the outlet of the first heat exchanger 100 (1080). When a supercooling degree K of the refrigerant is above an upper limit Kmax of a reference range on the basis of the temperature Tc of the refrigerant at the outlet of the first heat exchanger 100, since a ratio of a liquid refrigerant to the refrigerant discharged from the first heat exchanger 100 is high, cooling efficiency is decreased in the first mode 700 in which only the compressor 150 is separately driven.

Accordingly, it is determined whether the supercooling degree K of the refrigerant at the outlet of the first heat exchanger 100 is above the upper limit Kmax of the reference range (1090). When the supercooling degree K of the refrigerant at the outlet of the first heat exchanger 100 is not above the upper limit Kmax of the reference range, the air conditioner continuously operates in the first mode 700 and the starting operation of the flowchart is performed again such that the operation environment of the air conditioner 1 is determined again. When the supercooling degree K of the refrigerant at the outlet of the first heat exchanger 100 is above the upper limit Kmax of the reference range, it is determined whether the outlet pressure Pout of the pump 140 is less than an allowable pressure θ so as to check whether the pump 140 is driven without damage (1100).

Referring to FIGS. 1 to 3, the first bypass flow path 68 and the flow path 64 connected to the outlet side of the pump 140 are attached, pass the outlet valve 11 of the outdoor unit 10, and are connected to the indoor unit 20. Accordingly, since a refrigerant is flowing through the first bypass flow path 68 when the air conditioner 1 is operating in the first mode 700 as shown in FIG. 2, a pressure of the refrigerant at the first bypass flow path 68 becomes the outlet pressure Pout of the pump 140. It is necessary that the outlet pressure Pout of the pump 140 is lower than the allowable pressure θ such that the pump 140 may be driven without damage.

Since it is impossible to drive the pump 140 when the outlet pressure Pout of the pump 140 is not less than the allowable pressure θ, the starting operation of the flowchart is performed again and the operation environment of the air conditioner 1 is determined again while the air conditioner 1 continuously operates in the first mode 700.

When the outlet pressure Pout of the pump 140 is less than the allowable pressure θ, it is necessary to determine whether a difference between the outlet pressure Pout of the pump 140 and the inlet pressure Pin of the pump 140 is less than an allowable differential pressure γ of the pump 140 (1110). Although the outlet pressure Pout of the pump 140 is less than the allowable pressure θ, the pump 140 may be damaged when a differential pressure between the inlet and outlet of the pump 140 is not less than the allowable differential pressure γ.

Accordingly, since it is impossible to drive the pump 140 when the difference between the outlet pressure Pout of the pump 140 and the inlet pressure Pin of the pump 140 is not less than the allowable differential pressure γ of the pump 140, the starting operation of the flowchart is performed again and the operation environment of the air conditioner 1 is determined again while the air conditioner 1 continuously operates in the first mode 700.

When the difference between the outlet pressure Pout of the pump 140 and the inlet pressure Pin of the pump 140 is less than the allowable differential pressure γ of the pump 140, it may be determined that an environment capable of starting operation of the pump 140 is provided. As a next stage, it is determined whether switching the air conditioner 1 which is operating in the first mode 700 to operate in the third mode 900 is operating with high efficiency.

It may be determined, by measuring the rotational speed Vf of the air blowing fan 180 using the sensor 270 provided at the air blowing fan 180 to measure the rotational speed, whether switching the air conditioner 1 which is operating in the first mode 700 to operate in the third mode 900 is operating with high efficiency.

When the rotational speed Vf of the air blowing fan 180 decreases below a lower limit min of a reference range, it may be determined that heat exchange efficiency of the first heat exchanger 100 is decreased by supplying a refrigerant using only the compressor 150 (1130). Accordingly, when the rotational speed Vf of the air blowing fan 180 is below the lower limit min of the reference range, the air conditioner 1 which is operating in the first mode 700 is switched to operate in the third mode 900. When the rotational speed Vf of the air blowing fan 180 is not below the lower limit min of the reference range, the starting operation of the flowchart is performed again and the operation environment of the air conditioner 1 is determined again while the air conditioner 1 operates in the first mode 700.

FIG. 6 is a flowchart illustrating a method of controlling the expansion valve while the air conditioner shown in FIG. 1 operates in the third mode.

In the air conditioner 1 which is operating in the third mode 900 according to the flowcharts shown in FIGS. 5*a* to 5*c* (1200), a refrigerant discharged from the first heat exchanger 100 passes through the flow paths 61 and 62 at which the expansion valve 120 is provided and is supplied to the accumulator 130, and a refrigerant discharged from the indoor unit 20 passes through the flow path 65 at which the second control valve 170 is provided and is supplied to the accumulator 130.

To efficiently operate the compressor 150 and the pump 140 of the air conditioner 1, it is necessary to adjust amounts of a liquid refrigerant and a gaseous refrigerant supplied by the accumulator 130. An opening rate of the expansion valve 120 may be controlled so as to adjust the amounts of the liquid refrigerant and gaseous refrigerant.

A dryness D of a refrigerant which flows into the accumulator 130 and a dryness E of a refrigerant which is discharged from the first heat exchanger 100 and passes the expansion valve 120 are measured (1210). When the dryness D of the refrigerant which flows into the accumulator 130 is above an upper limit δmax of a reference range than the dryness E of the refrigerant which is discharged from the first heat exchanger 100 and passes the expansion valve 120 (1220), it means deficiency in a liquid refrigerant amount. Accordingly, the opening rate of the expansion valve 120 is increased so as to secure the liquid refrigerant amount (1230).

Also, when the dryness D of the refrigerant which flows into the accumulator 130 is below a lower limit δmin of the reference range than the dryness E of the refrigerant which is discharged from the first heat exchanger 100 and passes the expansion valve 120 (1240), it means deficiency in a gaseous refrigerant amount. Accordingly, the opening rate of the expansion valve 120 is reduced so as to secure the gaseous refrigerant amount (1250).

In detail, the dryness D of the refrigerant which flows into the accumulator 130 may be calculated using a mean enthalpy value hm of a refrigerant which passes the pump 140 and a refrigerant which passes the compressor 150 under evaporating pressure.

The mean enthalpy value hm of the refrigerant which passes the pump 140 and the refrigerant which passes the compressor 150 is obtained by a following equation.

Mean Enthalpy hm=[(Pump Flow Rate*Outlet Enthalpy of Indoor Unit)+(Compressor Flow Rate*Outlet Enthalpy of First Heat Exchanger)]/[Pump Flow Rate+Compressor Flow Rate]

Also, the dryness E of the refrigerant which passes the expansion valve 120 may be calculated using an enthalpy value of a refrigerant at the outlet of the first heat exchanger 100 under evaporating pressure.

FIG. 7 is a flowchart illustrating a method of controlling the compressor or the pump while the air conditioner shown in FIG. 1 operates in the third mode.

In the air conditioner 1 which is operating in the third mode 900 according to the flowcharts shown in FIGS. 5*a* to 5*c* (1300), rotational speeds of the compressor 150 and the pump 140 may be adjusted for efficient operation.

A rotational speed Vp of the pump 140 is measured (1310). When the rotational speed Vp of the pump 140 is less than a rotational speed limit v (1320), the rotational speed Vp of the pump 140 is increased (1330). When the pump 140 rotates at the rotational speed limit v (1340), the dryness D of the refrigerant which flows into the accumulator 130 and the dryness E of the refrigerant which is discharged from the first heat exchanger 100 and passes the expansion valve 120 are measured (1350).

When the dryness D of the refrigerant which flows into the accumulator 130 is above the upper limit δmax of the reference range than the dryness E of the refrigerant which is discharged from the first heat exchanger 100 and passes the expansion valve 120 (1360), it indicates a sufficient amount of gaseous refrigerant. Accordingly, a speed Vc of the compressor 150 is increased (1370).

Also, when the dryness D of the refrigerant which flows into the accumulator 130 is below the lower limit δmin of the reference range than the dryness E of the refrigerant which is discharged from the first heat exchanger 100 and passes the expansion valve 120 (1380), it indicates a deficient amount of a gaseous refrigerant. Accordingly, the speed Vc of the compressor 150 is reduced (1390).

FIG. 8 is a flowchart illustrating a method of controlling the air blowing fan while the air conditioner shown in FIG. 1 operates in the second mode.

In the air conditioner 1 which is operating in the second mode 800 according to the flowcharts shown in FIGS. 5*a* to 5*c* (1400), the rotational speed Vf of the air blowing fan 180 may be adjusted for efficient operation.

A temperature Tc of a refrigerant at the outlet of the first heat exchanger 100 is measured by the temperature sensor 210 provided at the outlet of the first heat exchanger 100 (1410). When the supercooling degree K of the refrigerant is below the lower limit Kmin of the reference range on the basis of the temperature Tc of the refrigerant at the outlet of the first heat exchanger 100 (1420), the rotational speed Vf of the air blowing fan 180 is increased so as to increase heat exchange efficiency of the first heat exchanger 100 (1430).

Also, when the supercooling degree K of the refrigerant is above the upper limit Kmax of the reference range on the basis of the temperature Tc of the refrigerant at the outlet of the first heat exchanger 100 (1440), since the supercooling degree K of the refrigerant at the outlet of the first heat exchanger 100 is unnecessarily high, the rotational speed Vf of the air blowing fan 180 is reduced (1450).

FIG. 9 is a flowchart illustrating a method of controlling the air blowing fan while the air conditioner shown in FIG. 1 operates in the third mode.

In the air conditioner 1 which is operating in the third mode 900 according to the flowcharts shown in FIGS. 5*a* to 5*c* (1500), the rotational speed Vf of the air blowing fan 180 may be adjusted for efficient operation.

When a compression ratio R which is a ratio between an inlet pressure and an outlet pressure of the compressor 150 is equal to or lower than a minimum compression ratio Rmin, the compressor 150 can not perform a function of the compressor 150.

Accordingly, the compression ratio R of the compressor 150 is measured by a sensor 280 for measuring the compression ratio R of the compressor 150 (1510). When the compression ratio R is more than a minimum compression ratio Rmin (1520), since the compressor 150 normally operates, the rotational speed Vf of the air blowing fan 180 is increased (1530). When the compression ratio R is less than the minimum compression ratio Rmin (1540), the rotational speed Vf of the air blowing fan 180 is reduced (1550).

FIG. 10 is a flowchart illustrating a method of controlling the air conditioner shown in FIG. 1 such that the air conditioner, which operates in the second mode or the third mode, is switched to the first mode.

In the air conditioner 1 which is operating in the second mode 800 or the third mode 900 according to the flowcharts shown in FIGS. 5*a* to 5*c*, when it is impossible to achieve a target cooling effect through refrigerant circulation by the pump 140, although cooling by the compressor 150 is inefficient, it is possible to switch operation to be in the first mode 700 so as to achieve the target cooling effect.

A saturation temperature Tp of a refrigerant at the outlet of the pump 140 is measured by a temperature sensor 230 provided at the flow path 64 (1610). When the saturation temperature Tp of the refrigerant at the outlet of the pump 140 is below a lower limit w of a reference range set at the indoor unit 20 by the input portion 200 (1620), since it is impossible to cool to a setting temperature through the refrigerant circulation by the pump 140, operation is switched to the first mode 700 in which the compressor 150 is separately driven.

Also, while the air conditioner 1 is operating in the second mode 800 or the third mode 900, when power consumption of the pump 140 is reduced to be equal to or below a reference, a differential pressure of the pump 140 is reduced to be equal to or below a reference, a difference between the outdoor temperature Tout and the indoor temperature Tin becomes smaller to be equal to or lower than a reference a, and a liquid level in the reservoir 110 becomes lower to be equal to or below a reference, the pump 140 is determined to be incapable of normally circulating a refrigerant and switched to the first mode 700 such that only the compressor 150 is separately driven.

Hereinafter, an air conditioner 2 according to another embodiment of the present invention will be described with reference to FIGS. 11 to 13.

FIG. 11 is a view illustrating a state in which a compressor and a pump of the air conditioner according to another embodiment of the present invention are driven simultaneously, FIG. 12 is a view illustrating a state in which only a compressor of the air conditioner shown in FIG. 11 is driven, and FIG. 13 is a view illustrating a state in which only a pump of the air conditioner shown in FIG. 11 is driven.

Referring to FIGS. 11 to 13, in the air conditioner 2 according to another embodiment of the present invention, it is possible to dispose a second outdoor unit 40 configured to circulate a refrigerant through a pump 440 between a first outdoor unit 30 and the indoor unit 20, which are already installed.

The air conditioner 2 includes the first outdoor unit 30 including a first heat exchanger 300 and the indoor unit 20 including the second heat exchanger 21. Generally, in a cooling operation, the first heat exchanger 300 included in the first outdoor unit 30 is used as a condenser and the second heat exchanger 21 included in the indoor unit 20 is used as an evaporator.

The air conditioner 2 may include a compressor 350 and the expansion device 22, which form a refrigeration cycle. The compressor 350 may be included in the first outdoor unit 30, and the expansion device 22 may be included in the indoor unit 20.

Also, when an outdoor temperature is lower, by more than a certain degree, than an indoor temperature, the air conditioner 2 includes the second outdoor unit 40 which includes the pump 440 for efficiently operating the air conditioner 2.

Also, the second outdoor unit 40 may include a first accumulator 430 capable of separating a refrigerant discharged from the first heat exchanger 300 of the first outdoor unit 30 or the second heat exchanger 21 of the indoor unit 20 into a liquid and a gas and the supplying the liquid and gas to the pump 440 and the compressor 350 of the first outdoor unit 30.

A gaseous refrigerant collected at the first accumulator 430 is discharged from the second outdoor unit 40 and supplied to the first outdoor unit 30 through a flow path 86 which connects an outlet provided at a top of the first accumulator 430 to a first outlet valve 41 of the second outdoor unit 40. The gaseous refrigerant which flows into an inlet valve 32 of the first outdoor unit 30 approaches a four-way valve 390 at which a flow path is switched according to a cooling operation and a heating operation, through a flow path 72 connected to the inlet valve 32 and flows through a flow path 73 connected to a second accumulator 310. Leaving a liquid refrigerant, condensed while the refrigerant flows, at the second accumulator 310 to prevent the compressor 350 from being damaged, only the gaseous refrigerant is supplied again to the compressor 350 through a flow path 74 which connects an outlet provided at a top of the second accumulator 310 to the compressor 350.

The compressor 350 may compress the gaseous refrigerant discharged from the second accumulator 310 and may supply the gaseous refrigerant to the first heat exchanger 300 of the first outdoor unit 30 through the four-way valve 390. A check valve 33 is provided at a flow path 75 which connects the compressor 350 to the four-way valve 390 such that the gaseous refrigerant flows to only the four-way valve 390 side, and the gaseous refrigerant which flows into the four-way valve 390 is supplied to the first heat exchanger 300 through a flow path 76 which connects the four-way valve 390 to the first heat exchanger 300.

A condensed refrigerant discharged from the first heat exchanger 300 may be supplied to the second outdoor unit 40 through the first heat exchanger 300 and an outlet valve 31 of the first outdoor unit. An expansion valve 320 may be provided at a flow path 71 which connects the first heat exchanger 300 to the outlet valve 31 of the first outdoor unit 30, and a bypass flow path at which a check valve 34 is provided may be provided in parallel with the expansion valve 320 to allow a refrigerant to reversely flow during a heating operation.

A refrigerant which is discharged from the first outdoor unit 30 and flows into a first inlet valve 42 of the second outdoor unit 40 may be supplied to the first accumulator 430 through flow paths 87 and 82 connected to the first accumulator 430. An expansion valve 420 with an opening rate adjusted according to a supercooling degree of a refrigerant discharged from the first outdoor unit 30 may be provided at the flow paths 87 and 82 which connect the first inlet valve to the first accumulator 430. A reservoir 410 for storing a liquid refrigerant to be pressurized at the pump 440 may be provided at the flow path 87 which connects the first inlet valve 42 of the second outdoor unit 40 to the expansion valve 420. A liquid level sensor (not shown) capable of checking an amount of a stored liquid refrigerant may be provided at the reservoir 410.

The flow path 82 which connects the expansion valve 420 to the first accumulator 430 is attached to a flow path 85 which connects the indoor unit 20 to the first accumulator 430, in detail, the flow path 85 which connects a second inlet valve 44, through which a refrigerant flows from the indoor unit 20 into the second outdoor unit 40, to the first accumulator 430. A control valve 470 provided at the flow path which connects the second inlet valve 44 to the first accumulator 430 may be opened when it is necessary to drive the compressor 350 and the pump 440 simultaneously due to an outdoor temperature lower, by a reference or more, than an indoor temperature.

A liquid refrigerant collected at the first accumulator 430 is supplied to the pump 440 through a flow path 83 which connects an outlet provided at a bottom of the first accumulator 430 to the pump 440.

The pump 440 may pressurize the liquid refrigerant discharged from the first accumulator 430 and may supply the liquid refrigerant to the indoor unit 20 through a second outlet valve 43 of the second outdoor unit 40. A check valve 46 is provided at a flow path 84 which connects the pump 440 to the second outlet valve 43 so as to allow the liquid refrigerant to flow through only the second outlet valve 43, and the refrigerant discharged from the second outdoor unit 40 through the second outlet valve 43 is supplied to the indoor unit 20.

The air conditioner 2 may further include a first bypass flow path 88 which diverges from the flow path 87, which connects the first inlet valve 42 of the second outdoor unit 40 to the expansion valve 420, so as to perform a cooling operation using only the compressor 150 provided at the first outdoor unit 30 without using the pump 440 provided at the second outdoor unit 40 when a normal cooling operation, which is not low-temperature cooling in which an outdoor temperature is lower than an indoor temperature, is necessary. The first bypass flow path 88 connects the first outdoor unit 30 to the indoor unit 20 to prevent a refrigerant from passing through the pump 440, and a control valve 460 capable of adjusting a refrigerant flow may be provided at the first bypass flow path 88.

Also, the air conditioner 2 may further include a third heat exchanger 400 and a second bypass flow path 89 to perform a cooling operation using only the pump 440 of the second outdoor unit 40 without using the compressor 350 of the first outdoor unit 30 when a low-temperature cooling operation is performed due to an outdoor temperature lower, by a certain degree or more, than an indoor temperature. The third heat exchanger 400 heat-exchanges a refrigerant discharged from the indoor unit 20, and the second bypass flow path 89 connects the indoor unit 20 or the second inlet valve 44 of the second outdoor unit 40 to the third heat exchanger 400 to prevent the refrigerant from passing through the compressor 350 of the first outdoor unit 30. A control valve 471 capable of adjusting a refrigerant flow through supply a refrigerant discharged from the indoor unit 20 only when the third heat exchanger 400 is used may be provided at the second bypass flow path 89.

A flow path 81 provided at an outlet side of the third heat exchanger 400 so as to supply a refrigerant discharged from the third heat exchanger 400 to the first accumulator 430 may be attached to the flow paths 87 and 82 which connect the first inlet valve 42 of the second outdoor unit 40 to the first accumulator 430. A check valve 45 which allows only a flow of a refrigerant discharged from the third heat exchanger 400 may be provided at the flow path 81 provided at the outlet side of the third heat exchanger 400 to prevent a refrigerant which flows into the first inlet valve 42 of the second outdoor unit 40 from flowing into the third heat exchanger 400

Also, the first outdoor unit 30 may include an air blowing fan 380 which is provided at the first heat exchanger 300 side and helps heat exchange at the first heat exchanger 300 by allowing air to flow into the first heat exchanger 300, and the second outdoor unit 40 may include an air blowing fan 480 which is provided at the third heat exchanger 400 and helps heat exchange at the third heat exchanger 400 by allowing air to flow into the third heat exchanger 400.

Also, the air conditioner 2 may include a variety of sensors which provide operation environment information of the air conditioner to operate by driving both the compressor 350 and the pump 440 simultaneously as shown in FIG. 11, driving only the compressor 350 as shown in FIG. 12, or driving only the pump 440 as shown in FIG. 13.

Particularly, the air conditioner 2 may include the temperature sensor 210 provided at the flow path 81 connected to an outlet side of the third heat exchanger 400 of the second outdoor unit 40 and may include the first pressure sensor 240 and the second pressure sensor 220 provided at the flow path 84 connected to an outlet side of the pump 440 and the flow path 83 connected to an inlet side thereof, respectively. Also, the temperature sensor 230 provided at the flow path 84 connected to the outlet of the pump 440 may be included.

The air conditioner 2 may perform all the same functions as those of the air conditioner 1 according to one embodiment of the present invention, which has been described above with reference to FIGS. 1 to 10, by additionally installing the second outdoor unit 40 in addition to the first outdoor unit 30 and the indoor unit 20 which are already installed.

Hereinafter, an air conditioner 3 according to still another embodiment of the present invention will be described with reference to FIGS. 14 to 15.

FIG. 14 is a view illustrating a state in which only a compressor of the air conditioner according to still another embodiment of the present invention is driven, and FIG. 15 is a view illustrating a state in which only a pump of the air conditioner shown in FIG. 14 is driven.

Referring to FIGS. 14 to 15, in a air conditioner 3 according to still another embodiment of the present invention, it is possible to dispose a second outdoor unit 50 configured to circulate a refrigerant through a pump 540 between the first outdoor unit 30 and the indoor unit 20, which are already installed.

The first outdoor unit 30 and the indoor unit 20 of the air conditioner 3 have the same components as those of the first outdoor unit 30 and the indoor unit 20 of the air conditioner 2 according to the embodiment shown in FIGS. 11 to 13.

Accordingly, in a cooling operation, a refrigerant, which flows into the inlet valve 32 of the first outdoor unit 30, passes through the compressor 350 and the first heat exchanger 300 of the first outdoor unit 30 and flows out through the outlet valve 31 like the method shown in FIGS. 11 to 13.

A refrigerant discharged through the outlet valve 31 of the first outdoor unit 30 flows into the second outdoor unit 50 through a first inlet valve 52 of the second outdoor unit 50. The second outdoor unit 50 may receive a refrigerant from the first outdoor unit 30 and supply the refrigerant to the indoor unit 20 through a first transfer flow path 95 which connects the first inlet valve 52 of the second outdoor unit 50 to a first outlet valve 53 or may receive a refrigerant from the first outdoor unit 30 and supply the refrigerant to the first outdoor unit 30 through a second transfer flow path 96 which connects a second inlet valve 54 of the second outdoor unit 50 to a second outlet valve 51.

Accordingly, when a normal cooling operation, which is not low-temperature cooling in which an outdoor temperature is lower than an indoor temperature, is necessary, the second outdoor unit 50 may perform a function of only transferring a refrigerant without passing through internal components of the second outdoor unit 50 by opening a first valve 58 provided at the first transfer flow path 95 and a second valve 57 provided at the second transfer flow path 96.

Meanwhile, in the case of low-temperature cooling in which an outdoor temperature is lower, by a certain degree or more, than an indoor temperature, the air conditioner 3 may collect a refrigerant from the first outdoor unit 30 and perform a cooling operation using the second outdoor unit 50 including the pump 540.

The second outdoor unit 50 may include a third heat exchanger 500 which heat-exchanges a refrigerant discharged from the indoor unit 20, an accumulator 510 which separates a refrigerant discharged from the third heat exchanger 500 into a liquid and a gas, and the pump 540 which pressurizes a liquid refrigerant discharged from the accumulator 510 and supplies the pressurized liquid refrigerant to the indoor unit 20.

A refrigerant, which flows from the indoor unit 20 into the second outdoor unit 50 through the second inlet valve 54, may be supplied to the third heat exchanger 500 through a flow path 94 which diverges from the second transfer flow path 96 and connects the second inlet valve 54 to the third heat exchanger 500. A third valve 55 may be provided at the flow path 94 which connects the second inlet valve 54 to the third heat exchanger 500. When a low-temperature cooling operation is performed using the second outdoor unit 50, the second valve 57 is closed and the third valve 55 is opened.

A refrigerant, which flows into the third heat exchanger 500, passes through a flow path 91, which connects an outlet of the third heat exchanger 500 to the accumulator 510, and flows into the accumulator 510. A liquid refrigerant separated at the accumulator 510 passes through a flow path 92 which connects an outlet of the accumulator 510 to the pump 540 and flows into the pump 540.

A refrigerant pressurized at the pump 540 may pass through a flow path 93 connected to an outlet of the pump 540 and attached to the first transfer flow path 95 and be supplied to the indoor unit 20 through the first outlet valve 53 of the second outdoor unit 50. The check valve 46 which allows only a flow of a refrigerant toward the indoor unit 20 may be provided at the flow path 93 connected to the outlet of the pump 540. When a low-temperature cooling operation is performed using the second outdoor unit 50, the first valve 58 is closed.

Also, the second outdoor unit 50 may include an air blowing fan 580 which is provided at the third heat exchanger 500 and helps heat exchange at the third heat exchanger 500 by allowing air to flow into the third heat exchanger 500.

The air conditioner 3 may include a variety of sensors which provide operation environment information of the air conditioner to operate by driving only the compressor 350 as shown in FIG. 14 or driving only the pump 440 as shown in FIG. 15.

Particularly, the air conditioner 3 may include the temperature sensor 210 provided at the flow path 91 connected to the outlet side of the third heat exchanger 500 of the second outdoor unit 50 and may include the first pressure sensor 240 and the second pressure sensor 220 provided at the flow path 93 connected to the outlet side of the pump 540 and the flow path 92 connected to an inlet side thereof, respectively. Also, the temperature sensor 230 provided at the flow path 93 connected to the outlet of the pump 540 may be included.

The second outdoor unit 50 of the air conditioner 3 has a structure simpler than that of the second outdoor unit 40 of the air conditioner 2 according to another embodiment of the present invention described above with reference to FIGS. 11 to 13.

Accordingly, a user may configure the air conditioner 3 capable of performing pump circulation in a low-temperature cooling environment at a low cost by additionally installing the second outdoor unit 50 in addition to the first outdoor unit 30 and the indoor unit 20 which are already installed.

The scope of the present invention is not limited the above-described particular embodiments. It should be appreciated by those skilled in the art that changes may be made in these embodiments without departing from the principles and spirit of the disclosure, the scope of which is defined in the claims and their equivalents.

The invention claimed is:

1. An air conditioner comprising:

an outdoor unit which comprises a first heat exchanger;

an indoor unit which comprises a second heat exchanger;

an accumulator configured to separate a refrigerant discharged from the first heat exchanger or the indoor unit into a liquid refrigerant and a gas refrigerant;

a compressor configured to compress the gas refrigerant discharged from the accumulator and to supply the compressed gas refrigerant to the first heat exchanger;

a pump configured to pressurize the liquid refrigerant discharged from the accumulator and to supply the pressurized liquid refrigerant to the indoor unit; and a controller configured to control the air conditioner to cause the refrigerant to circulate through the first heat exchanger, the pump and the indoor unit without circulating through the compressor, based on a difference between an outdoor temperature and an indoor temperature and based on an outlet pressure of the pump and an inlet pressure of the pump.

2. The air conditioner of claim 1, further comprising:

an expansion valve provided at a flow path which connects the first heat exchanger to the accumulator and configured to be adjusted to have an opening rate according to a supercooling degree of the refrigerant discharged from the first heat exchanger; and a control valve provided at a flow path which connects the indoor unit to the accumulator and configured to be opened when the outdoor temperature is lower, by a reference or more, than the indoor temperature.

3. The air conditioner of claim 2, further comprising a reservoir provided at a flow path, which connects the first heat exchanger to the expansion valve, to store the refrigerant.

4. The air conditioner of claim 1, further comprising:

a first check valve configured to allow the refrigerant to flow from the compressor to the first heat exchanger; and a second check valve configured to allow the refrigerant to flow from the pump to the indoor unit.

5. The air conditioner of claim 1, further comprising a bypass flow path which connects the first heat exchanger to the indoor unit to prevent the refrigerant from passing through the pump and at which a control valve is configured to adjust a refrigerant flow is provided.

6. The air conditioner of claim 1, further comprising a bypass flow path which connects the indoor unit to the first heat exchanger to prevent the refrigerant from passing through the compressor and at which a check valve is configured to allow a refrigerant flow from the indoor unit to the first heat exchanger.

7. A method of controlling an air conditioner in a cooling operation of the air conditioner according to claim 1, comprising:

controlling the air conditioner by the controller to operate in:

a first mode in which the refrigerant circulates through the first heat exchanger, the compressor, and the indoor unit but does not circulate through the pump;

a second mode in which the refrigerant circulates through the first heat exchanger, the pump, and the indoor unit but does not circulate through the compressor; and a third mode in which the refrigerant circulates through the first heat exchanger, the compressor, the pump, and the indoor unit.

8. The method of claim 7, wherein the first mode comprises:

closing an expansion valve provided at a first flow path, at which the pump is provided, to prevent the refrigerant discharged from the first heat exchanger from flowing through the first flow path;

opening a first control valve provided at a first bypass flow path connected to the indoor unit to allow the refrigerant discharged from the first heat exchanger to flow through the first bypass flow path; and opening a second control valve provided at a second flow path, at which the compressor is provided, to allow the refrigerant discharged from the indoor unit to flow through the second flow path instead of flowing through a second bypass flow path which directly connects the indoor unit to the first heat exchanger.

9. The method of claim 7, wherein the second mode comprises:

opening an expansion valve provided at a first flow path, at which the pump is provided, to allow the refrigerant discharged from the first heat exchanger to flow through the first flow path;

closing a first control valve provided at a first bypass flow path connected to the indoor unit, to prevent the refrigerant discharged from the first heat exchanger from flowing through the first bypass flow path; and closing a second control valve provided at a second flow path, at which the compressor is provided, to allow the refrigerant discharged from the indoor unit to flow through a second bypass flow path which directly connects the indoor unit to the first heat exchanger instead of flowing through the second flow path.

10. The method of claim 7, wherein the third mode comprises:

opening an expansion valve provided at a first flow path, at which the pump is provided, to allow the refrigerant discharged from the first heat exchanger to flow through the first flow path;

closing a first control valve provided at a first bypass flow path connected to the indoor unit, to prevent the refrigerant discharged from the first heat exchanger from flowing through the first bypass flow path; and opening a second control valve provided at a second flow path, at which the compressor is provided, to allow the refrigerant discharged from the indoor unit to flow through the second flow path instead of flowing through a second bypass flow path which directly connects the indoor unit to the first heat exchanger.

11. The method of claim 7, further comprising:

determining whether the outdoor temperature is lower, by a reference or more, than the indoor temperature; and measuring the pressure at the outlet of the pump and the pressure at the inlet of the pump after determining whether the accumulator has sufficient liquid refrigerant to drive the pump, wherein when the outdoor temperature is lower, by the reference or more, than the indoor temperature and a difference between the pressure at the outlet of the pump and the pressure at the inlet thereof is equal to or above a lower limit of a reference range, the air conditioner is operated in the second mode when the air conditioner is in a stopped state or to switch to the third mode when the air conditioner is operating in the first mode.

12. The method of claim 11, wherein when the air conditioner operates in the first mode, the method further comprises measuring a temperature of the refrigerant at an outlet of the first heat exchanger and measuring the pressure at the inlet of the pump and the pressure at the outlet of the pump, and wherein when a supercooling degree of the refrigerant at the outlet of the first heat exchanger is above an upper limit of a reference range, the pressure at the outlet of the pump is equal to and lower than an allowable pressure of the pump, and the difference between the pressures at the inlet and outlet of the pump is equal to and lower than an allowable differential pressure of the pump, the method is able to switch to the third mode.

13. The method of claim 11, wherein when the air conditioner operates in the first mode, the method further comprises measuring a rotational speed of an air blowing fan which allows air to flow into the first heat exchanger, and wherein when the rotational speed of the air blowing fan is below a lower limit of a reference range, the method is able to switch to the third mode.

14. The method of claim 11, wherein when the air conditioner operates in the second mode, the method further comprises measuring a temperature of a refrigerant at an outlet of the first heat exchanger, wherein when a supercooling degree of the refrigerant at the outlet of the first heat exchanger is below a lower limit of a reference range, the method is able to increase a rotational speed of an air blowing fan which allows air to flow into the first heat exchanger, and wherein when the supercooling degree of the refrigerant at the outlet of the first heat exchanger is above an upper limit of the reference range, the rotational speed of the air blowing fan is reduced.

15. The method of claim 11, wherein when the air conditioner operates in the second mode or the third mode, switching to the first mode when a difference between a set temperature of the indoor unit and a saturation temperature of the outlet of the pump is below a lower limit of a reference range.

* * * * *